US009125497B2

(12) United States Patent
Brykalski et al.

(10) Patent No.: US 9,125,497 B2
(45) Date of Patent: Sep. 8, 2015

(54) CLIMATE CONTROLLED BED ASSEMBLY WITH INTERMEDIATE LAYER

(71) Applicant: Gentherm Incorporated, Northville, MI (US)

(72) Inventors: Michael J. Brykalski, South Lyon, MI (US); David Marquette, Farmington Hills, MI (US); Robert Vidojevski, Brownstown, MI (US)

(73) Assignee: Gentherm Incorporated, Northville, MI (US)

( * ) Notice: Subject to any disclaimer, the term of this patent is extended or adjusted under 35 U.S.C. 154(b) by 0 days.

(21) Appl. No.: 13/774,947

(22) Filed: Feb. 22, 2013

(65) Prior Publication Data

US 2013/0269106 A1 Oct. 17, 2013

Related U.S. Application Data

(60) Provisional application No. 61/602,332, filed on Feb. 23, 2012.

(51) Int. Cl.
*A47C 21/04* (2006.01)

(52) U.S. Cl.
CPC ..... *A47C 21/048* (2013.01); *A47C 21/04* (2013.01); *A47C 21/044* (2013.01)

(58) Field of Classification Search
CPC ..... A47C 7/74; A47C 7/742; A47C 7/744; A47C 7/748; A47C 21/04; A47C 21/042; A47C 21/044; A47C 21/048; A61G 2007/05784; A61G 2007/05792; A61G 2210/70; A61G 2210/90
USPC ..... 5/284, 421, 422, 423, 652.1, 652.2, 5/726, 941
See application file for complete search history.

(56) References Cited

U.S. PATENT DOCUMENTS 96,989 A 11/1869 Somes
771,461 A 10/1904 Clifford (Continued)

FOREIGN PATENT DOCUMENTS

DE 10238552 8/2001
DE 10115242 10/2002

(Continued)

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

(Continued)

*Primary Examiner* — Nicholas Polita
*Assistant Examiner* — David R Hare
(74) *Attorney, Agent, or Firm* — Knobbe, Martens, Olson & Bear, LLP

(57) ABSTRACT

According to some embodiments, a climate controlled bed or other seating assembly comprises an upper portion or mattress having at least one fluid distribution member (e.g., spacer fabric) that is in fluid communication with the at least one internal passageway of the upper portion, wherein the at least one fluid distribution member is configured to at least partially distribute fluid within the fluid distribution member. In some embodiments, the internal passageway terminates at or near a bottom surface of the upper portion or mattress. The bed or other seating assembly additionally includes one or more inlays or interlays or intermediate layers, or components thereof, positioned between the upper portion and a foundation.

20 Claims, 22 Drawing Sheets

(56) References Cited

U.S. PATENT DOCUMENTS 2,461,432 A 2/1949 Mitchell
2,462,984 A * 3/1949 Maddison ..... 5/423
2,493,067 A 1/1950 Goldsmith
2,512,559 A 6/1950 Williams
2,782,834 A 2/1957 Vigo
2,791,956 A 5/1957 Guest
2,931,286 A 4/1960 Fry, Sr. et al.
2,976,700 A 3/1961 Jackson
3,030,145 A 4/1962 Kottemann
3,039,817 A 6/1962 Taylor
3,136,577 A 6/1964 Richard
3,137,523 A 6/1964 Karner
3,209,380 A 10/1965 Watsky
3,266,064 A 8/1966 Figman
3,529,310 A 9/1970 Olmo
3,550,523 A 12/1970 Segal
3,653,083 A 4/1972 Lapidus
3,928,876 A * 12/1975 Starr ..... 5/284
4,413,857 A 11/1983 Hayashi
4,423,308 A 12/1983 Callaway et al.
4,563,387 A 1/1986 Takagi et al.
4,671,567 A 6/1987 Frobose
4,685,727 A 8/1987 Cremer et al.
4,712,832 A 12/1987 Antolini et al.
4,777,802 A 10/1988 Feher
4,793,651 A 12/1988 Inagaki et al.
4,825,488 A 5/1989 Bedford
4,853,992 A 8/1989 Yu
4,905,475 A 3/1990 Tuomi
4,923,248 A 5/1990 Feher
4,981,324 A 1/1991 Law
4,997,230 A 3/1991 Spitalnick
5,002,336 A 3/1991 Feher
5,016,304 A 5/1991 Ryhiner
5,077,709 A 12/1991 Feher
5,102,189 A 4/1992 Saito et al.
5,106,161 A 4/1992 Meiller
5,117,638 A 6/1992 Feher
5,125,238 A 6/1992 Ragan et al.
5,265,599 A 11/1993 Stephenson et al.
5,335,381 A 8/1994 Chang
5,367,728 A 11/1994 Chang
5,372,402 A 12/1994 Kuo
5,382,075 A 1/1995 Shih
5,385,382 A 1/1995 Single, II et al.
5,416,935 A 5/1995 Nieh
5,419,489 A 5/1995 Burd
5,433,741 A 7/1995 Truglio
5,448,788 A 9/1995 Wu
5,473,783 A 12/1995 Allen
5,493,742 A 2/1996 Klearman
5,584,084 A 12/1996 Klearman et al.
5,597,200 A 1/1997 Gregory et al.
5,613,729 A 3/1997 Summer, Jr.
5,613,730 A 3/1997 Buie et al.
5,626,021 A 5/1997 Karunasiri et al.
5,626,386 A 5/1997 Lush
5,640,728 A 6/1997 Graebe
5,642,539 A 7/1997 Kuo
5,645,314 A 7/1997 Liou
5,675,852 A 10/1997 Watkins
5,692,952 A 12/1997 Chih-Hung
5,715,695 A 2/1998 Lord
5,850,741 A 12/1998 Feher
5,871,151 A 2/1999 Fiedrich
5,887,304 A 3/1999 von der Heyde
5,902,014 A 5/1999 Dinkel et al.
5,921,314 A 7/1999 Schuller et al.
5,921,858 A 7/1999 Kawai et al.
5,924,766 A 7/1999 Esaki et al.
5,924,767 A 7/1999 Pietryga
5,927,817 A 7/1999 Ekman et al.
5,934,748 A 8/1999 Faust et al.
5,948,303 A 9/1999 Larson
5,963,997 A 10/1999 Hagopian
6,003,950 A 12/1999 Larsson
6,006,524 A 12/1999 Park
6,019,420 A 2/2000 Faust et al.
6,048,024 A 4/2000 Wallman
6,052,853 A 4/2000 Schmid
6,059,018 A 5/2000 Yoshinori et al.
6,062,641 A 5/2000 Suzuki et al.
6,073,998 A 6/2000 Siarkowski et al.
6,079,485 A 6/2000 Esaki et al.
6,085,369 A 7/2000 Feher
6,109,688 A 8/2000 Wurz et al.
6,119,463 A 9/2000 Bell
6,145,925 A 11/2000 Eksin et al.
6,148,457 A 11/2000 Sul
6,161,241 A 12/2000 Zysman
6,171,333 B1 1/2001 Nelson et al.
6,186,592 B1 2/2001 Orizaris et al.
6,189,966 B1 2/2001 Faust et al.
6,189,967 B1 2/2001 Short
6,196,627 B1 3/2001 Faust et al.
6,206,465 B1 3/2001 Faust et al.
6,223,539 B1 5/2001 Bell
6,263,530 B1 7/2001 Feher
6,291,803 B1 9/2001 Fourrey
6,336,237 B1 1/2002 Schmid
6,341,395 B1 1/2002 Chao
6,425,527 B1 7/2002 Smole
6,487,739 B1 12/2002 Harker
6,493,888 B1 12/2002 Salvatini et al.
6,493,889 B2 12/2002 Kocurek
6,497,720 B1 12/2002 Augustine et al.
6,509,704 B1 1/2003 Brown
6,511,125 B1 1/2003 Gendron
6,541,737 B1 4/2003 Eksin et al.
6,546,576 B1 4/2003 Lin
RE38,128 E 6/2003 Gallup et al.
6,581,224 B2 * 6/2003 Yoon ..... 5/421
6,581,225 B1 6/2003 Imai
6,596,018 B2 7/2003 Endo et al.
6,598,251 B2 7/2003 Habboub et al.
6,604,785 B2 8/2003 Bargheer et al.
6,606,754 B1 8/2003 Flick
6,606,866 B2 8/2003 Bell
6,619,736 B2 9/2003 Stowe et al.
6,626,488 B2 9/2003 Pfahler
6,629,724 B2 10/2003 Ekern et al.
6,644,735 B2 11/2003 Bargheer et al.
6,676,207 B2 1/2004 Rauh et al.
6,684,437 B2 2/2004 Koenig
6,687,937 B2 2/2004 Harker
6,700,052 B2 3/2004 Bell
6,708,352 B2 3/2004 Salvatini et al.
6,711,767 B2 3/2004 Klamm
6,730,115 B1 5/2004 Heaton
6,761,399 B2 7/2004 Bargheer et al.
6,764,502 B2 7/2004 Bieberich
6,772,825 B2 8/2004 Lachenbuch et al.
6,782,574 B2 8/2004 Totton et al.
6,786,541 B2 9/2004 Haupt et al.
6,786,545 B2 9/2004 Bargheer et al.
6,808,230 B2 10/2004 Buss et al.
6,828,528 B2 12/2004 Stowe et al.
6,840,576 B2 1/2005 Ekern et al.
6,841,957 B2 1/2005 Brown
6,855,158 B2 * 2/2005 Stolpmann ..... 607/108
6,855,880 B2 2/2005 Feher
6,857,697 B2 2/2005 Brennan et al.
6,857,954 B2 2/2005 Luedtke
6,871,365 B2 3/2005 Flick et al.
6,893,086 B2 5/2005 Bajic et al.
6,904,629 B2 6/2005 Wu
6,907,739 B2 6/2005 Bell
6,954,944 B2 10/2005 Feher
6,967,309 B2 11/2005 Wyatt et al.
6,976,734 B2 12/2005 Stoewe
6,977,360 B2 12/2005 Weiss
6,990,701 B1 1/2006 Litvak
7,036,163 B2 5/2006 Schmid
7,036,575 B1 5/2006 Rodney et al.

(56) References Cited

U.S. PATENT DOCUMENTS 7,040,710 B2 5/2006 White et al.
7,052,091 B2 5/2006 Bajic et al.
7,063,163 B2 6/2006 Steele et al.
7,070,231 B1 7/2006 Wong
7,070,232 B2 7/2006 Minegishi et al.
7,100,978 B2 9/2006 Ekern et al.
7,108,319 B2 9/2006 Hartwich et al.
7,114,771 B2 10/2006 Lofy et al.
7,124,593 B2 10/2006 Feher
7,131,689 B2 11/2006 Brennan et al.
7,134,715 B1 11/2006 Fristedt et al.
7,147,279 B2 12/2006 Bevan et al.
7,168,758 B2 1/2007 Bevan et al.
7,178,344 B2 2/2007 Bell
7,181,786 B2 * 2/2007 Schoettle ..... 5/421
7,201,441 B2 4/2007 Stoewe et al.
7,272,936 B2 9/2007 Feher
7,296,315 B2 11/2007 Totton et al.
7,338,117 B2 3/2008 Iqbal et al.
7,356,912 B2 4/2008 Iqbal et al.
7,370,911 B2 5/2008 Bajic et al.
7,425,034 B2 9/2008 Bajic et al.
7,462,028 B2 12/2008 Cherala et al.
7,469,432 B2 12/2008 Chambers
7,475,464 B2 1/2009 Lofy et al.
7,478,869 B2 1/2009 Lazanja et al.
7,480,950 B2 1/2009 Feher
7,506,938 B2 3/2009 Brennan et al.
7,555,792 B2 7/2009 Heaton
7,587,901 B2 9/2009 Petrovski
7,591,507 B2 9/2009 Giffin et al.
7,640,754 B2 1/2010 Wolas
7,665,803 B2 2/2010 Wolas
7,708,338 B2 5/2010 Wolas
RE41,765 E 9/2010 Gregory et al.
7,827,620 B2 11/2010 Feher
7,827,805 B2 11/2010 Comiskey et al.
7,862,113 B2 1/2011 Knoll
7,866,017 B2 1/2011 Knoll
7,877,827 B2 * 2/2011 Marquette et al. ..... 5/423
7,892,271 B2 2/2011 Schock et al.
7,908,687 B2 * 3/2011 Ward et al. ..... 5/421
7,914,611 B2 3/2011 Vrzalik et al.
7,937,789 B2 5/2011 Feher
7,963,594 B2 6/2011 Wolas
7,966,835 B2 6/2011 Petrovski
7,996,936 B2 8/2011 Marquette et al.
8,065,763 B2 * 11/2011 Brykalski et al. ..... 5/423
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
8,505,320 B2 8/2013 Lofy
8,516,842 B2 8/2013 Petrovski
8,539,624 B2 9/2013 Terech et al.
8,575,518 B2 11/2013 Walsh
8,621,687 B2 1/2014 Brykalski et al.
2002/0100121 A1 8/2002 Kocurek
2003/0019044 A1 1/2003 Larsson et al.
2003/0070235 A1 4/2003 Suzuki et al.
2003/0084511 A1 5/2003 Salvatini et al.
2003/0145380 A1 8/2003 Schmid
2003/0150060 A1 8/2003 Huang
2003/0160479 A1 8/2003 Minuth et al.
2003/0188382 A1 10/2003 Klamm et al.
2003/0234247 A1 12/2003 Stern
2004/0090093 A1 5/2004 Kamiya et al.
2004/0177622 A1 9/2004 Harvie
2004/0255364 A1 12/2004 Feher
2005/0011009 A1 1/2005 Wu
2005/0086739 A1 4/2005 Wu
2005/0173950 A1 8/2005 Bajic et al.
2005/0278863 A1 * 12/2005 Bahash et al. ..... 5/726
2005/0285438 A1 12/2005 Ishima et al.
2005/0288749 A1 12/2005 Lachenbruch
2006/0053529 A1 3/2006 Feher
2006/0053558 A1 3/2006 Ye
2006/0087160 A1 4/2006 Dong et al.
2006/0130490 A1 6/2006 Petrovski
2006/0137099 A1 6/2006 Feher
2006/0137358 A1 6/2006 Feher
2006/0158011 A1 7/2006 Marlovits et al.
2006/0162074 A1 7/2006 Bader
2006/0197363 A1 9/2006 Lofy et al.
2006/0214480 A1 9/2006 Terech
2006/0273646 A1 12/2006 Comiskey et al.
2007/0035162 A1 2/2007 Bier et al.
2007/0040421 A1 2/2007 Zuzga et al.
2007/0069554 A1 3/2007 Comiskey et al.
2007/0086757 A1 4/2007 Feher
2007/0138844 A1 6/2007 Kim
2007/0158981 A1 7/2007 Almasi et al.
2007/0200398 A1 8/2007 Wolas et al.
2007/0251016 A1 11/2007 Feher
2007/0261548 A1 * 11/2007 Vrzalik et al. ..... 95/52
2007/0262621 A1 11/2007 Dong et al.
2007/0277313 A1 12/2007 Terech
2007/0296251 A1 12/2007 Krobok et al.
2008/0000025 A1 1/2008 Feher
2008/0028536 A1 2/2008 Hadden-Cook
2008/0047598 A1 2/2008 Lofy
2008/0087316 A1 4/2008 Inaba et al.
2008/0148481 A1 * 6/2008 Brykalski et al. ..... 5/423
2008/0164733 A1 7/2008 Giffin et al.
2008/0166224 A1 7/2008 Giffin et al.
2008/0173022 A1 7/2008 Petrovski
2008/0263776 A1 10/2008 O'Reagan
2009/0000031 A1 1/2009 Feher
2009/0025770 A1 1/2009 Lofy
2009/0026813 A1 1/2009 Lofy
2009/0033130 A1 2/2009 Marquette et al.
2009/0106907 A1 4/2009 Chambers
2009/0126109 A1 5/2009 Lee
2009/0126110 A1 5/2009 Feher
2009/0218855 A1 9/2009 Wolas
2010/0011502 A1 * 1/2010 Brykalski et al. ..... 5/423
2010/0146700 A1 6/2010 Wolas
2010/0193498 A1 8/2010 Walsh
2010/0235991 A1 9/2010 Ward et al.
2011/0010850 A1 * 1/2011 Frias ..... 5/423
2011/0041246 A1 * 2/2011 Li et al. ..... 5/421
2011/0107514 A1 * 5/2011 Brykalski et al. ..... 5/421
2011/0115635 A1 5/2011 Petrovski et al.
2011/0253340 A1 10/2011 Petrovski
2011/0289684 A1 12/2011 Parish et al.
2011/0314837 A1 12/2011 Parish et al.
2012/0017371 A1 1/2012 Pollard
2012/0080911 A1 4/2012 Brykalski et al.
2012/0114512 A1 5/2012 Lofy et al.
2012/0131748 A1 5/2012 Brykalski et al.
2012/0261399 A1 10/2012 Lofy
2012/0319439 A1 12/2012 Lofy
2013/0086923 A1 4/2013 Petrovski et al.
2013/0097776 A1 4/2013 Brykalski et al.
2013/0097777 A1 4/2013 Marquette et al.
2013/0206852 A1 8/2013 Brykalski et al.
2013/0227783 A1 9/2013 Brykalski et al.
2013/0239592 A1 9/2013 Lofy
2014/0007594 A1 1/2014 Lofy

(56) References Cited

U.S. PATENT DOCUMENTS

| | | | | |
|---|---|---|---|---|
| 2014/0033441 | A1* | 2/2014 | Morgan et al. | 5/724 |
| 2014/0182061 | A1* | 7/2014 | Zaiss et al. | 5/423 |
| 2014/0189951 | A1* | 7/2014 | DeFranks et al. | 5/423 |

FOREIGN PATENT DOCUMENTS

| | | | |
|---|---|---|---|
| EP | 0 617 946 | | 3/1994 |
| EP | 0 621 026 | | 10/1994 |
| EP | 0 862 901 | | 9/1998 |
| EP | 0878 150 | | 11/1998 |
| EP | 1 804 616 | | 2/2012 |
| FR | 1 327 862 | | 5/1963 |
| FR | 2 790 430 | | 9/2000 |
| GB | 2 251 352 | | 12/2000 |
| JP | 56-97416 | | 8/1981 |
| JP | S62-193457 | U | 12/1987 |
| JP | H04-108411 | A | 4/1992 |
| JP | H06-343664 | A | 12/1994 |
| JP | H07-003403 | U | 1/1995 |
| JP | H09-140506 | A | 6/1997 |
| JP | H10-165259 | A | 6/1998 |
| JP | H11-266968 | A | 10/1999 |
| JP | 2004-174138 | | 6/2004 |
| JP | 2 893 826 | | 6/2007 |
| RU | 2297207 | | 4/2007 |
| WO | WO 97/17930 | | 5/1997 |
| WO | WO 99/02074 | | 1/1999 |
| WO | WO 01/78643 | | 10/2001 |
| WO | WO 01/84982 | | 11/2001 |
| WO | WO 02/11968 | | 2/2002 |
| WO | WO 02/058165 | | 7/2002 |
| WO | WO 03/051666 | | 6/2003 |
| WO | WO 2005/120295 | | 12/2005 |
| WO | WO 2007/060371 | | 5/2007 |
| WO | WO 2011/150427 | | 12/2011 |

OTHER PUBLICATIONS

Feher, Steve, Stirling Air Conditioned Variable Temperature Seat (SVTS) and Comparison with Thermoelectric Air Conditioned Variable Temperature Seat (VTS), SAE Technical Paper Series, International Congress and Exposition, No. 980661, Feb. 23-26, 1998, pp. 1-9.

Lofy, J. et al., Thermoelectrics for Environmental Control in Automobiles, Proceeding of Twenty-First International Conference on Thermoelectrics (ICT 2002), published 2002, pp. 471-476.

Okamoto et. al., The Effects of a Newly Designed Air Mattress upon Sleep and Bed Climate, Applied Human Science, vol. 16 (1997), No. 4 pp. 161-166.

Winder et al., Heat-retaining Mattress for Temperature Control in Surgery, Br Med J, Jan. 17, 1970 1:168.

I-CAR Advantage Online: The Climate Control Seat System, online article dated Aug. 27, 2001.

Product information for a "*Thermo-Electric Cooling & Heating Seat Cushion*"; retrieved on May 12, 2008 from http://www.coolorheat.com/.

Product information retrieved on Jan. 30, 2007 from http://store.yahoo.co.jp/maruhachi/28tbe20567.html (no English translation available).

Product information for "Kuchofuku's air conditioned bed, clothing line," retrieved on Oct. 11, 2007 from http://www.engadget.com/2007/06/29/kuchofukus-air-conditioned-bed-clothing-line/.

Product information for "SleepDeep™," retrieved on or about Jun. 2008 from http://www.sleepdeep.se.

* cited by examiner

CLIMATE CONTROLLED BED ASSEMBLY WITH INTERMEDIATE LAYER

CROSS-REFERENCE TO RELATED APPLICATIONS

This application claims the priority benefit under 35 U.S.C. §119(e) of U.S. Provisional Application No. 61/602,332, filed Feb. 23, 2012, the entirety of which is hereby incorporated by reference herein. The disclosure of U.S. patent application Ser. No. 11/872,657, filed on Oct. 15, 2007 and issued as U.S. Pat. No. 8,065,763 on Nov. 29, 2011, and U.S. patent application Ser. No. 12/505,355, filed on Jul. 17, 2009 and issued as U.S. Pat. No. 8,181,290 on May 22, 2012, are hereby incorporated by reference herein and made a part of the present application.

BACKGROUND

1. Field

This application relates to climate control, and more specifically, to climate controlled beds (e.g., adjustable beds, stationary beds, etc.) assemblies and other seating assemblies.

2. Description of the Related Art

Temperature-conditioned and/or ambient air for environmental control of living or working space is typically provided to relatively extensive areas, such as entire buildings, selected offices, suites of rooms within a building or the like. In the case of enclosed areas, such as homes, offices, libraries and the like, the interior space is typically cooled or heated as a unit. There are many situations, however, in which more selective or restrictive air temperature modification is desirable. For example, it is often desirable to provide an individualized climate control for a bed or other seating device so that desired heating or cooling can be achieved. For example, a bed situated within a hot, poorly-ventilated environment can be uncomfortable to the occupant. Furthermore, even with normal air-conditioning, on a hot day, the bed occupant's back and other pressure points may remain sweaty while lying down. In the winter time, it is highly desirable to have the ability to quickly warm the bed of the occupant to facilitate the occupant's comfort, especially where heating units are unlikely to warm the indoor space as quickly. Therefore, a need exists to provide improved designs of adjustable (e.g., reclinable) and/or stationary climate-controlled bed assemblies.

SUMMARY

According to some embodiments, a climate controlled bed or other seating assembly (e.g., seat, chair, etc.) comprises an upper portion or mattress having at least one fluid distribution member (e.g., spacer fabric) that is in fluid communication with the at least one internal passageway of the upper portion, wherein the at least one fluid distribution member is configured to at least partially distribute fluid within the fluid distribution member. In some embodiments, the internal passageway terminates at or near a bottom surface of the upper portion or mattress. The bed or other seating assembly additionally includes one or more inlays or interlays (or inlay or interlay components) or intermediate layers positioned between the upper portion (or mattress) and a foundation. In some embodiments, the inlay or interlay component comprises at least one fluid module. For example, at least one fluid module is positioned at least partially within the interlay component. In some embodiments, the fluid module comprises a fluid transfer device (e.g., blower, fan, etc.) that is configured to selectively transfer air or other fluid through at least one outlet located along or near (e.g., above or below) a top (e.g., a top surface) of the interlay component.

According to some embodiments, when the upper portion is properly positioned relative to the interlay component, the at least one outlet of the interlay is generally aligned and in fluid communication with the at least one internal passageway of the upper portion or mattress. In one embodiment, the interlay component comprises at least one fluid channel that extends to an edge of the at least one interlay component, wherein such a fluid channel is in fluid communication with an inlet of a fluid module. In other embodiments, the inlet of a fluid module is in fluid communication with an opening or window along the bottom of the interlay, either in addition to or in lieu of the inlet channel. In some embodiments, when the bed or other seating assembly is in use, air is delivered from an environment surrounding the bed to the inlet of the at least one fluid module at least in part through the at least one fluid channel of the interlay component. In one embodiment, air or other fluid discharged by the fluid module is transferred through the outlet and an internal passageway of the upper portion to one or more fluid distribution members of the assembly.

According to some embodiments, a fluid module is embedded, at least partially, within a recess of the interlay or inlay component. In one embodiment, a fluid module further comprises a thermal and/or environmental conditioning device (e.g., thermoelectric device, convective heater, another type of heating or cooling device or component, a dehumidifying device, etc.). In some embodiments, the interlay component additionally comprises at least one waste channel extending from one or more fluid modules to an edge (e.g., foot-end edge, head-end edge, side edge, etc.) of the interlay component and thus the bed or other seating assembly into which the interlay is incorporated. In some embodiments, the bed further comprises at least one conduit extending at least partially through both the opening of the interlay component and an internal passageway of the upper portion or mattress.

According to some embodiments, the bed or other seating assembly comprises two, three, four or more fluid modules. In some embodiments, each fluid module comprises its own outlet that is configured to align and be placed in fluid communication with a passageway of the adjacent mattress or upper portion. According to some embodiments, the bed or other seating assembly comprises a fixed, non-adjustable bed assembly, an adjustable, reclinable bed (e.g., wherein the upper portion and the at least one interlay component are configured to bend along an angle when the bed is adjusted while still permitting air to be delivered from the at least one fluid module to the at least one fluid distribution member of the upper portion), a futon, a sofa, a chair and/or any other type of seating assembly.

According to some embodiments, the foundation or lower portion of the bed or other seating assembly is configured to selectively bend together with the upper portion and the interlay or inlay component, the upper portion or mattress and/or any other portion or component of the assembly. In some embodiments, the foundation comprises a plurality of segments that facilitate in allowing the foundation to bend. In one embodiment, such segments are separated by gaps or spaces that permit air or other fluid to flow into one or more fluid modules of the interlay component from or near the bottom of the foundation (or space defined therein). In one embodiment, the interlay component is temporarily or permanently secured to the upper portion using one or more adhesives, mechanical fasteners or any other type of attachment device, feature or method. In other embodiments, the interlay component is separate and detached or selectively detachable from the upper portion.

According to some embodiments, an adjustable climate controlled bed comprises an upper portion comprising at least one fluid distribution member, wherein the fluid distribution member is in fluid communication with the at least one internal passageway of the upper portion and wherein the at least one fluid distribution member is configured to at least partially distribute fluid within the at least one fluid distribution member. In some embodiments, the at least one internal passageway terminates at a rear surface of the upper portion. The adjustable bed further comprises a lower portion configured to be positioned below the upper portion and to generally support the upper portion, the lower portion comprising a lower support member and an intermediate support member. In some embodiments, the intermediate support member is positioned above the lower support member and is generally secured to the lower support member. In one embodiment, the lower support member comprises at least one opening extending through the lower support member, wherein at least one fluid module is configured to be positioned below the lower support member. In some embodiments, the at least one fluid module is configured to be in fluid communication with the at least one opening of the lower support member.

According to some embodiments, the at least one intermediate support member comprises at least one slotted cavity or opening that at least partially aligns with the at least one opening of the lower support member, a size of the at least one slotted cavity being larger than a size of the at least one opening of the lower support member when viewed from above. In some embodiments, the at least one internal passageway of the upper portion generally aligns with the at least one slotted cavity of the intermediate support member when the upper portion is properly positioned on the lower portion. In some embodiments, the at least one internal passageway is configured to move relative to the at least one slotted cavity while a position of the adjustable bed is modified during use. In some embodiments, the at least one internal passageway remains aligned with and in fluid communication with the at least one slotted cavity regardless of the relative movement of the at least one internal passageway and the at least one slotted cavity in order to maintain the at least one internal passageway in fluid communication with the at least one slotted cavity, the at least one opening of the lower support member and the at least one fluid module.

According to some embodiments, the fluid distribution member comprises a spacer material (e.g., a spacer fabric). In some embodiments, the at least one slotted cavity of the intermediate support member comprises a total of two, three, four or more slotted cavities. In some embodiments, the at least one fluid module comprises at least fluid transfer device (e.g., blower, fan, pump, etc.). In some embodiments, the at least one fluid module is configured to environmentally and/or thermally condition (e.g., heat, cool, dehumidify, etc.) air or fluid passing therethrough. In some embodiments, the at least one fluid module comprises at least one thermoelectric device (e.g., Peltier circuit). In some embodiments, the at least one fluid module comprises at least one convective heater and/or any other heating and/or cooling device.

According to some embodiments, the fluid distribution member is divided into at least two (e.g., two, three, four, more than four) hydraulically isolated zones, wherein each of the zones comprises a spacer material (e.g., spacer fabric) or other fluid distribution member. According to some embodiments, each of the zones is in fluid communication with a different fluid module, so that each zone can be separately controlled. In some embodiments, the fluid distribution member is divided into at least two zones using sew seams, stitching, glue beads, a window pane design, other fluid barrier and/or other feature, device or member. In some embodiments, the at least one fluid module is secured directly to a rear surface of the lower portion. In one embodiment, the at least one fluid module is separate from the lower portion, wherein the at least one fluid module is placed in fluid communication with the at least one opening of the lower support member using at least one fluid conduit. In some embodiments, the lower portion is secured to a movable frame. In some embodiments, the upper portion comprises at least one of foam, springs, latex, a comfort layer and/or any other component, device, layer and/or material.

According to certain arrangements, a climate controlled bed includes an upper portion comprising a core with a top core surface and a bottom core surface. The core includes at least one passageway extending from the top core surface to the bottom core surface. The upper portion of the bed further includes at least one fluid distribution member positioned above the core, wherein the fluid distribution member is in fluid communication with at least one passageway of the core. The fluid distribution member is configured to at least partially distribute fluid within said fluid distribution member. The upper portion of the bed further comprises at least one comfort layer positioned adjacent to the fluid distribution member. The bed also includes a lower portion configured to support the upper portion and at least one fluid module configured to selectively transfer air to or from the fluid distribution member of the upper portion. In some arrangements, the fluid module includes a fluid transfer device and a thermoelectric device for selectively thermally conditioning fluids being transferred by the fluid transfer device.

According to some embodiments, a climate controlled bed includes an upper portion comprising a core having a top core surface and a bottom core surface. The core includes one or more passageways extending from the top core surface to the bottom core surface. The upper portion of the bed further includes at least one fluid distribution member, having one or more spacers, in fluid communication with the passageway of the core and at least one comfort layer positioned adjacent to the fluid distribution member. In some embodiments, the bed additionally includes a lower portion configured to support the upper portion and at least one fluid module configured to selectively transfer air to or from the fluid distribution member of the upper portion.

In some embodiments, the spacer comprises a spacer fabric, a spacer material and/or any other member that is configured to generally allow fluid to pass therethrough. In one embodiment, the spacer is generally positioned within a recess of the fluid distribution member. In other arrangements, the upper portion further comprises a barrier layer positioned underneath the spacer, the barrier layer being generally impermeable to fluids. In some embodiments, the barrier layer comprises a tight woven fabric, a film and/or the like.

According to some arrangements, the fluid distribution member is divided into at least two hydraulically isolated zones, each of said zones comprising a spacer. In one embodiment, each of the zones is in fluid communication with a different fluid module, so that each zone can be separately controlled. In other embodiments, the fluid distribution member is divided into two or more zones using sew seams, stitching, glue beads and/or any other flow blocking member or features.

In some arrangements, the fluid module is positioned within an interior of the lower portion of the bed. In one embodiment, the fluid module comprises a blower, fan or other fluid transfer device. In other embodiments, the fluid module additionally comprises a thermoelectric device configured to selectively heat or cool fluid being transferred by the fluid transfer device.

According to some embodiments, a passageway insert is generally positioned within at least one of the passageways of the core. In one embodiment, a passageway insert comprises one or more bellows, liners (e.g., fabric liners), coatings (e.g., liquid coatings), films and/or the like. In other arrangements, the lower portion includes a top surface comprising at least one lower portion opening being configured to align with and be in fluid communication with a passageway of the core. In one arrangement, one of the lower portion opening and the passageway comprises a fitting, the fitting being adapted to fit within the other of the lower portion opening and the passageway when the lower portion and the upper portion of are properly aligned.

In some embodiments, the comfort layer comprises a quilt layer or other cushioned material. In some arrangements, the core comprises closed-cell foam and/or other types of foam. In other arrangements, the fluid distribution member comprises foam. In one embodiment, the comfort layer is generally positioned above the fluid distribution member. In other arrangements, an additional comfort layer is generally positioned between the fluid distribution member and the core. In some embodiments, the bed further includes one or more flow diverters located adjacent to the fluid distribution member, wherein the flow diverters are configured to improve the distribution of a volume of air within an interior of the fluid distribution member.

According to some embodiments, the bed additionally includes a main controller configured to control at least the operation of the fluid module. In other arrangements, the climate controlled bed assembly further comprises one or more temperature sensors configured to detect a temperature of a fluid being transferred by the fluid module. In other embodiments, the bed assembly can include one or more humidity sensors and/or other types of sensors configured to detect a property of a fluid, either in lieu of or in addition to a temperature sensor. In one embodiment, the bed additionally includes at least one remote controller configured to allow a user to selectively adjust at least one operating parameter of the bed. In some arrangements, the remote controller is wireless. In other embodiments, the remote controller is hardwired to one or more portions or components of the bed. In some arrangements, a single upper portion is positioned generally on top of at least two lower portions. In some embodiments, the fluid module is configured to deliver air or other fluid toward an occupant positioned on the bed. In other arrangements, the fluid module is configured to draw air or other fluid away an occupant positioned on the bed.

According to other embodiments, a climate controlled bed includes an upper portion comprising a core with a top core surface and a bottom core surface, a passageway configured to deliver fluid from one of the top core surface and the bottom core surface to the other of the top core surface and the bottom core surface, one or more fluid distribution members in fluid communication with the passageway and at least one comfort layer positioned adjacent to the fluid distribution member. In one embodiment, the fluid distribution member includes one or more spacers. The climate controlled bed further includes a lower portion configured to support the upper portion and at least one fluid module configured to selectively transfer air to or from the fluid distribution member of the upper portion through the passageway. In some embodiments, passageway is routed through the core. In other arrangements, the passageway is external or separate from the core, or is routed around the core.

In accordance with some embodiments of the present inventions, a climate controlled bed comprises a cushion member having an outer surface comprising a first side for supporting an occupant and a second side, the first side and the second side generally facing in opposite directions, the cushion member having at least one recessed area along its first side or its second side. In one embodiment, the bed further includes a support structure having a top side configured to support the cushion member, a bottom side and an interior space generally located between the top side and the bottom side, the top side and the bottom side of the support structure generally facing in opposite directions, a flow conditioning member at least partially positioned with the recessed area of the cushion member, an air-permeable topper member positioned along the first side of the cushion member and a fluid temperature regulation system. The fluid temperature regulation system includes a fluid transfer device, a thermoelectric device (TED) and a conduit system generally configured to transfer a fluid from the fluid transfer device to the thermoelectric device. The fluid temperature regulation system is configured to receive a volume of fluid and deliver it to the flow conditioning member and the topper member.

In one embodiment, a temperature control member for use in a climate controlled bed includes a resilient cushion material comprising at least one recessed area along its surface, at least one layer of a porous material, the layer being configured to at least partially fit within the recessed area of the cushion and a topper member being positioned adjacent to the cushion and the layer of porous material, the topper member being configured to receive a volume of air that is discharged from the layer of porous material towards an occupant.

According to some embodiments, a bed comprises a substantially impermeable mattress, having a first side and a second side, the first side and the second side being generally opposite of one another, the mattress comprising at least one opening extending from the first side to the second side, a flow conditioning member positioned along the first side of the mattress and being in fluid communication with the opening in mattress, at least one top layer being positioned adjacent to the flow conditioning member, wherein the flow conditioning member is generally positioned between the mattress and the at least one top layer and a fluid transfer device and a thermoelectric unit that are in fluid communication with the opening in the mattress and the flow conditioning member.

In accordance with some embodiments of the present inventions, a climate controlled bed comprises a cushion member having a first side for supporting an occupant and a second side, the first side and the second side generally facing in opposite directions, a support structure having a top side configured to support the cushion member, a bottom side and an interior space generally located between the top side and the bottom side, the top side and the bottom side of the support structure generally facing in opposite directions, at least one flow conditioning member at least partially positioned on the first side of the cushion member, wherein the flow conditioning member is configured to provide a conditioned fluid to both the occupant's front and back sides when the occupant is laying on the cushion member in the supine position and a fluid temperature regulation system.

The climate controlled bed can also have an air-permeable distribution layer positioned on the flow conditioning member proximate the occupant and configured to provide conditioned fluid to both the occupant's front and back sides, when the occupant is laying on the cushion member in the supine position, and an air-impermeable layer that can be generally positioned along the part of the at least one flow conditioning member and can be configured to provide conditioned fluid to the front side of the occupant, when the occupant is laying on the cushion member in the supine position and along the opposite side of the at least one flow conditioning member from the air-permeable distribution layer. The fluid temperature regulation system can have a fluid transfer device, a thermoelectric device and a conduit system generally configured to transfer a fluid from the fluid transfer device to the thermoelectric device. The fluid temperature regulation system can be configured to receive a volume of fluid and deliver it to the flow conditioning member and through the air-permeable distribution layer to the occupant.

According to some embodiments, the flow conditioning member can be configured to substantially surround an occupant. In certain embodiments, the bed can have a fluid barrier configured to minimize fluid communication between a fluid inlet and a waste fluid outlet of the fluid temperature regulation system, wherein the fluid barrier can isolate a first region of the interior space of the support structure from a second region, wherein the fluid inlet and waste fluid outlet are within different regions of the support structure or one is within the interior space and one is outside of the interior space.

In one embodiment, a bed includes a substantially impermeable mattress, having a first side and a second side, the first side and the second side being generally opposite of one another, the mattress comprising at least two openings extending from the first side to the second side, a first set of at least one flow conditioning member positioned along the first side of the mattress, a second set of at least one flow conditioning member positioned only partially on the first side of the mattress, each set being in fluid communication with a group of at least one of the at least two openings in the mattress to the exclusion of the other set, at least one distribution layer being positioned adjacent to the flow conditioning members, wherein the first set is generally positioned between the mattress and the at least one distribution layer, an air impermeable layer, wherein the second set is positioned between the air impermeable layer and the at least one distribution layer, the at least one distribution layer or layers either folded other itself or positioned adjacent to one another when an occupant is not in the bed and surrounding the occupant when the occupant is in the bed, a fluid transfer device, a first set at least one thermoelectric unit and a second set of at least one thermoelectric unit, each set of thermoelectric units in fluid communication with a corresponding set of at least one flow conditioning members.

According to some embodiments, a climate controlled bed can have a conditioning region. The conditioning region can comprise a central fluid conditioning region, a fluid conditioning member, a fluid distribution member and a fluid impermeable member. The conditioning region can provide conditioned fluid to the central fluid conditioning region from multiple sides and angles of the condition region, including a top side and a bottom side. The central fluid conditioning region can generally conform to the shape of an object within the central fluid conditioning region. The fluid conditioning member can surround the central fluid conditioning region. The fluid distribution member can be along a surface of the fluid conditioning member and can also surround the central fluid conditioning region. The fluid impermeable member can be along part of a surface of the fluid condition member and can form a top side of the conditioning region.

BRIEF DESCRIPTION OF THE DRAWINGS

These and other features, aspects and advantages of the present inventions are described with reference to drawings of certain preferred embodiments, which are intended to illustrate, but not to limit, the present inventions. It is to be understood that the attached drawings are provided for the purpose of illustrating concepts of the present inventions and may not be to scale.

DETAILED DESCRIPTION OF THE PREFERRED EMBODIMENTS

This application is generally directed to climate control systems for beds or other seating assemblies. The climate control system and the various systems and features associated with it are described herein in the context of bed assemblies (e.g., air chamber beds, adjustable beds, inner-spring beds, spring-free beds, memory foam beds, full foam beds, hospital beds, other medical beds, futons, sofas, reclining chairs, etc.) because they have particular utility in that context. However, the climate control system and the methods described herein, as well as their various systems and features, can be used in other contexts as well, such as, for example, but without limitation, seat assemblies for automobiles, trains, planes, motorcycles, buses, other types of vehicles, wheelchairs, other types of medical chairs, beds and seating assemblies, sofas, task chairs, office chairs, other types of chairs and/or the like.

The various embodiments described and illustrated herein, and equivalents thereof, generally disclose improved devices, assemblies and methods for supplying ambient and/or thermally conditioned air or other fluids to one or more portions of a bed assembly. As discussed in greater detail herein, as a result of such embodiments, air or other fluids can be conveyed to and/or from an occupant in a more efficient manner. For example, the various embodiments disclosed herein can provide simpler climate controlled seating assemblies that provide one or more operational benefits or advantages (e.g., quieter operation, operation with less vibration, more streamlined configurations that are capable of accommodating fixed and adjustable assemblies, etc.). In addition, the embodiments disclosed herein can provide improved fluid movement to, through and/or from a climate controlled bed or seating assembly.

Figure 1:
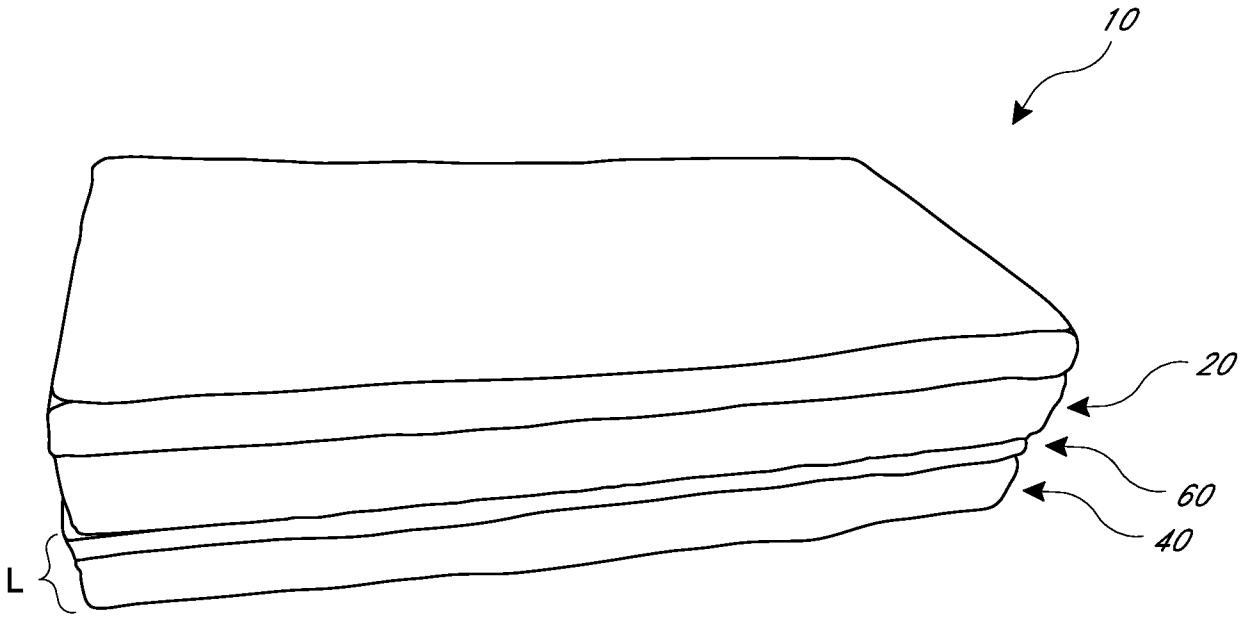
FIG. 1 illustrates a perspective view of one embodiment of a climate controlled adjustable bed configured to recline shown in a normal, non-reclined position.
Figure 2:
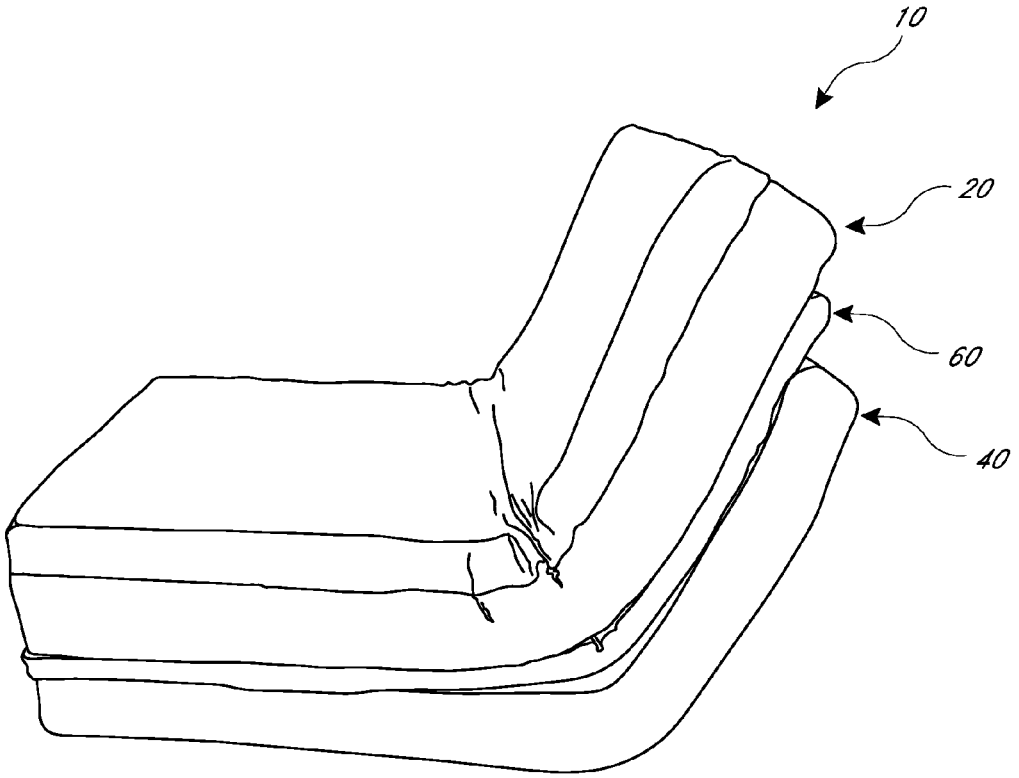
FIG. 2 illustrates the bed of FIG. 1 in a reclined (e.g., non-flat) position.

With reference to the perspective views of FIGS. 1 and 2, a climate controlled bed 10 can be configured to be adjustable or otherwise adapted to be selectively reclined or otherwise moved. As shown, the bed 10 can comprise one or more upper portions 20 (e.g., a mattress) that are sized, shaped and otherwise configured to support one or more occupants. The mattress 20 or other upper portion can comprise a standard shape and/or size (e.g., double, queen, king, etc.). However, in other embodiments, the mattress (and thus the corresponding bed assembly on which the mattress is situated) can include a non-standard size, shape and/or other configuration, as desired or required by a particular application or use.

With continued reference to FIGS. 1 and 2, the upper portion 20 or mattress can be designed to be removably or permanently positioned on top of a lower portion L or foundation of the bed assembly 10. In the illustrated embodiment, the lower portion L comprises a bottom or primary foundation 40 (or lower support member) and a top or secondary foundation 60 (e.g., intermediate support member, interlay or inlay component, etc.). The terms secondary foundation, intermediate support member, interlay, interlay component, inlay and inlay component are used interchangeably herein. As discussed in greater detail herein, the lower support member (e.g., foundation) 40 and the intermediate support member (e.g., inlay component) 60 can be attached or otherwise secured to each other (e.g., removably or permanently). The members 40, 60 can be held relative to each other using one or more attachment devices or methods, such as, for example, stitching, zippers, hook-and-loop connections, buttons, straps, bands, other fasteners, adhesives and/or the like. In other embodiments, the lower portion 40 can include more or fewer members or components, as desired or required.

As illustrated in FIG. 2, the adjustable bed 10 can be selectively moved (e.g., reclined) such that one portion of the assembly is angled relative to one or more other portions of the assembly. The bed 10 can be angled, reclined and/or otherwise moved with the assistance of one or more motors, actuators and/or other mechanical, electromechanical, pneumatic or other type of device.

Figure 3:
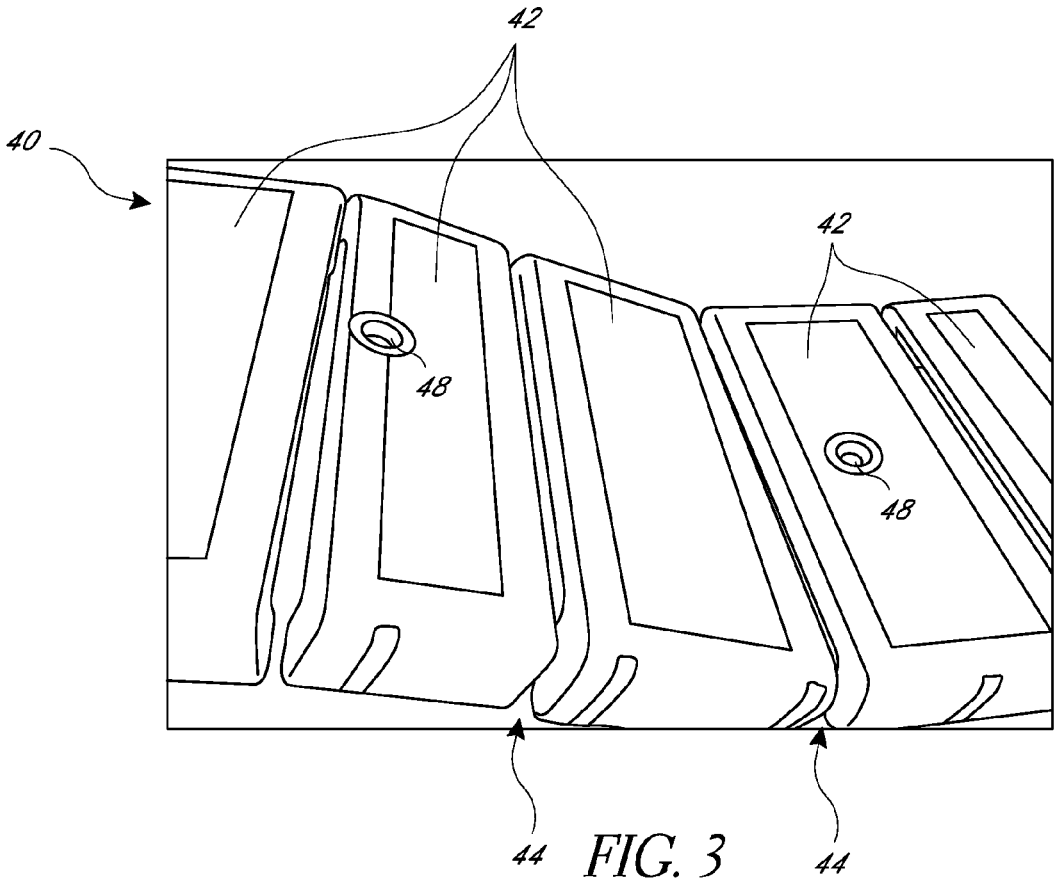
FIG. 3 illustrates a perspective view of one embodiment of a primary foundation or lower support member configured for use with the movable climate controlled bed of FIGS. 1 and 2.

With reference to FIG. 3, the lower support member or foundation (e.g., primary foundation) 40 can comprise a plurality of segmented sections 42 that are configured to move relative to each other to accommodate movement of the adjustable bed during use. For example, the assembly 10 of FIGS. 1 and 2 comprises a lower support member 40 having a total of seven segmented sections 42. However, in other embodiments, the number of sections 42 can be greater or less than seven (e.g., 2, 3, 4, 5, 6, 8, 9, 10, more than 10, etc.), as desired or required. These segmented sections 42 provide the bed assembly 10 with the necessary flexibility and/or bendability as the adjustable bed is moved between different positions or configurations during use. Adjacent segmented sections 42 can be separated by gaps, spaces or other joints 44 that are configured to permit one section 42 to angle or other move relative to the adjacent section 42. The amount of permitted movement between adjacent sections 42 can be selected based on one or more factors, such as, for example, the size of the sections, the size of the bed assembly 10, the amount flexibility or bendability required or desired for the assembly and/or the like.

With continued reference to FIG. 3, the sections 42 that comprise the lower support member 40 can include one or more openings or passages 48. Air or other fluids delivered by one or more fluid modules (not shown in FIG. 3) can be selectively delivered through the passages 48 to transfer such air or other fluids from the fluid modules, at least partially through the lower portion L and/or the upper portion 20 of the bed assembly 10, e.g., toward one or more occupants positioned on the assembly.

A fluid module can include a fluid transfer device (e.g., blower, fan, etc.), a thermal conditioning device (e.g., a Peltier device, other thermoelectric device or TED, a convective heater, a heat pump, another type of heating and/or cooling device or component, etc.), a dehumidifier and/or any other type of conditioning device. Some embodiments of a fluid module comprise one or more conduits to place the various components of the fluid module and other portions of the bed 10 in fluid communication with each other and/or the like. The various components of a fluid module can be included within a single housing or can be separated from one another but fluidly connected (e.g., using one or more conduits). Accordingly, thermally or environmentally conditioned air (and/or ventilated or ambient air) can be directed toward the lower portion L and/or the upper portion 20 by the one or more fluid modules. In any of the embodiments disclosed herein, or equivalents thereof, the fluid module can include a heating, cooling and/or other conditioning (e.g., temperature, humidity, etc.) device that is not a thermoelectric device. For example, such a conditioning device can include a convective heater, a heat pump, a dehumidifier and/or the like.

Additional information regarding thermoelectric devices, convective heaters and other conditioning devices is provided in U.S. patent application Ser. No. 11/047,077, filed on Jan. 31, 2005 and issued as U.S. Pat. No. 7,587,901 on Sep. 15, 2009, U.S. patent application Ser. No. 12/049,120, filed Mar. 14, 2008 and issued as U.S. Pat. No. 8,143,554 on Mar. 27, 2012, U.S. patent application Ser. No. 12/695,602, filed Jan. 28, 2010 and published as U.S. Publication No. 2010/0193498 on Aug. 5, 2010, and U.S. patent application Ser. No. 13/289,923, filed Nov. 4, 2011 and published as U.S. Publication No. 2012/0114512 on May 10, 2012 the entireties of all of which are hereby incorporated by reference herein and made a part of the present application.

In some embodiments, one or more fluid modules are fixedly or removably secured to the rear surface of the lower support member 40. For example, a fluid module can be attached to a rear surface (e.g., the surface that generally faces toward the ground when the bed 10 is generally horizontally positioned) and/or to the segmented section 42 so as to generally or completely align an outlet of the fluid module to the fluid passage or opening 48. Thus, air or other fluid can be selectively delivered through the lower support member 40 (e.g., toward and through the intermediate support member 60 and the upper support member or mattress 20 of the bed assembly 10). In some embodiments, each fluid passage or opening 48 is placed in fluid communication with at least one fluid module. In some embodiments, a single fluid module can be configured to deliver air or other fluid to two or more passages or openings 48 of the lower support member 40. Further, in some arrangements, two or more fluid modules can be placed in fluid communication with a single fluid passage 48, as desired or required. In other embodiments, however, one or more fluid modules can be positioned, at least partially, within an intermediate layer or interlay of a climate controlled bed or other seating assembly.

The fluid modules can be secured directly to the rear surface of the lower support member 40 (e.g., to one or more of the segmented sections 42). Alternatively, the fluid modules can be attached to another portion of the bed's foundation or another portion of the bed assembly (e.g., a frame that holds or otherwise supports the lower support member 40, an interlay or inlay component, etc.). The fluid modules can be powered using any one of a number of power sources, such as, for example, a power cord (e.g., in electrical communication with an AC plug or power generator), one or more batteries and/or the like.

Figure 4:
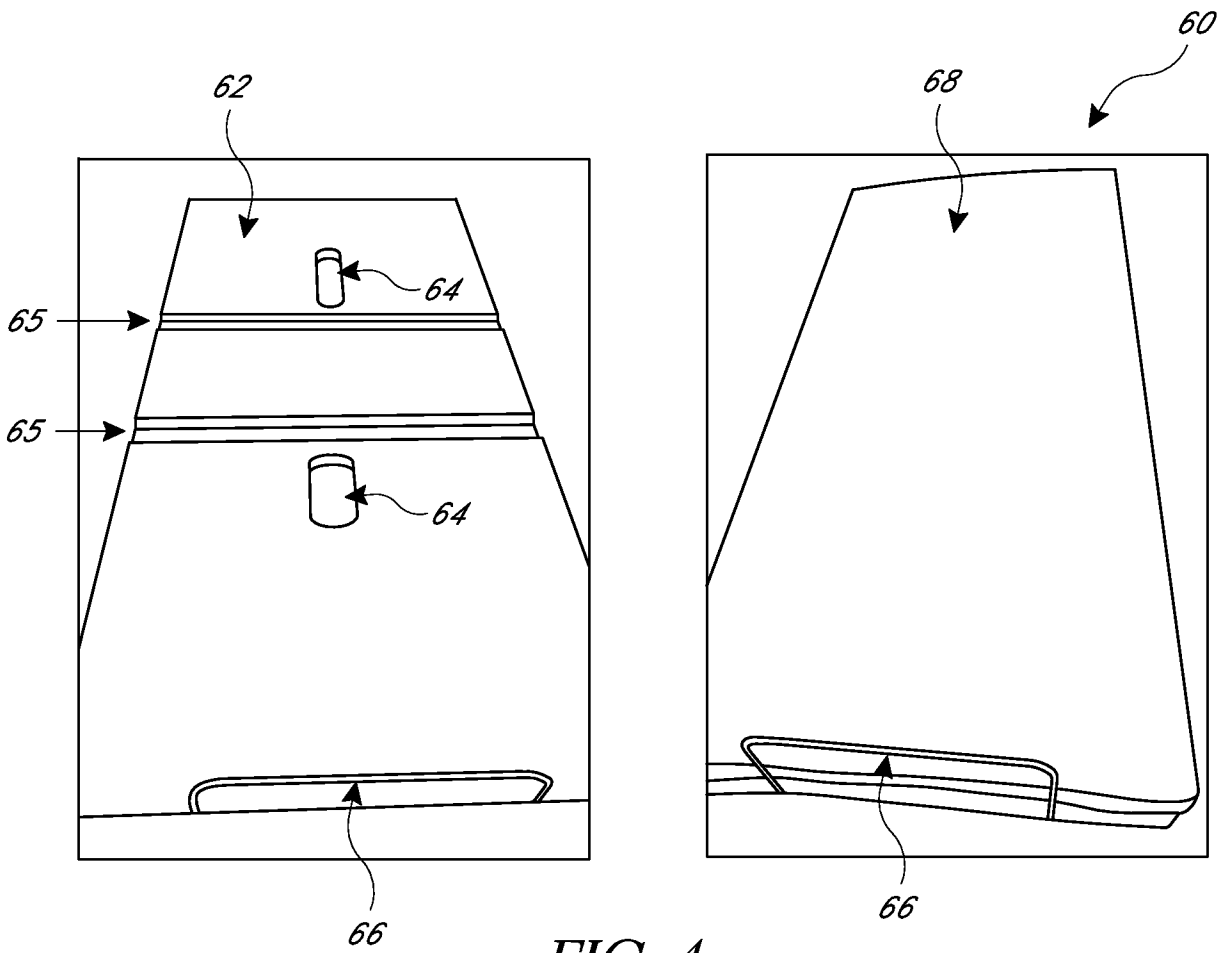
FIG. 4 illustrates different top perspective views of one embodiment of an intermediate support member or interlay component configured for use with the movable climate controlled bed of FIGS. 1 and 2.

One embodiment of an intermediate support member or interlay 60 is illustrated in FIG. 4. As shown, the intermediate support member or interlay 60 can include one or more slotted openings or cavities 64 formed therein. In some embodiments, the intermediate support member 60 can be initially manufactured with the slotted openings or cavities 64 (e.g., using injection molding, other molding techniques, etc.). Alternatively, however, such openings 64 can be formed after the main body of the intermediate support member 60 has been manufactured (e.g., by selectively cutting or otherwise removing certain portions of the member 60). Regardless of how they are formed or created, the slotted openings or cavities 64 can be shaped, sized and/or otherwise configured to permit air or other fluids to pass from the fluid modules, through the lower support L and/or the upper support (e.g., mattress) 20 while the bed assembly is in any reclined position and/or while the position of the bed assembly is being modified.

With continued reference to FIG. 4, the slotted openings 64 of the intermediate support member 60 can be configured to pass only partially through a vertical section (e.g., generally perpendicular to the ground when the bed 10 is generally horizontally positioned) of the member 60. As shown, a lower section 62 of the intermediate support member or interlay 60 (which, in some embodiments, comprises one or more slotted openings 64) can be selectively covered by an upper, generally continuous section 68. The upper section 68 can comprise open foam and/or another type of air-permeable or partially air-permeable material to allow air or other fluid to freely pass from the slotted opening 64 to the top of the intermediate support member 60 via the upper section 68. In other embodiments, however, the intermediate support member or inlay component 60 comprises one or more slotted openings, passages or other cavities 64 that extend through the entire vertical portion of the member 60.

As depicted in the arrangement of FIG. 4, the interlay component 60 can include one or more slots 65 (e.g., cutouts, hinges, perforations, etc.) to facilitate bending of the component 60 when the bed assembly 10 is in use. In certain embodiments, the intermediate support member or inlay 60 (and/or the lower support member 40 to which the member 60 is fixedly or removably attached) comprises one or more bars, rails, guides, fasteners or other retention assemblies or members 66. Such retention assemblies 66 can help maintain a proper orientation between the upper portion or mattress 20 and the lower support L (e.g., the intermediate support member or interlay component 60, the lower support member 40, etc.) as the position of the bed is modified (e.g., reclined, otherwise moved, etc.), during use. However, one or more other types of retention members (e.g., straps, fasteners, etc.) can be used to hold a desired orientation between the upper portion 20 and the lower portion L while the adjustable bed is in use, either in addition to or in lieu of the rails or retention members 66 illustrated herein.

Figure 5:
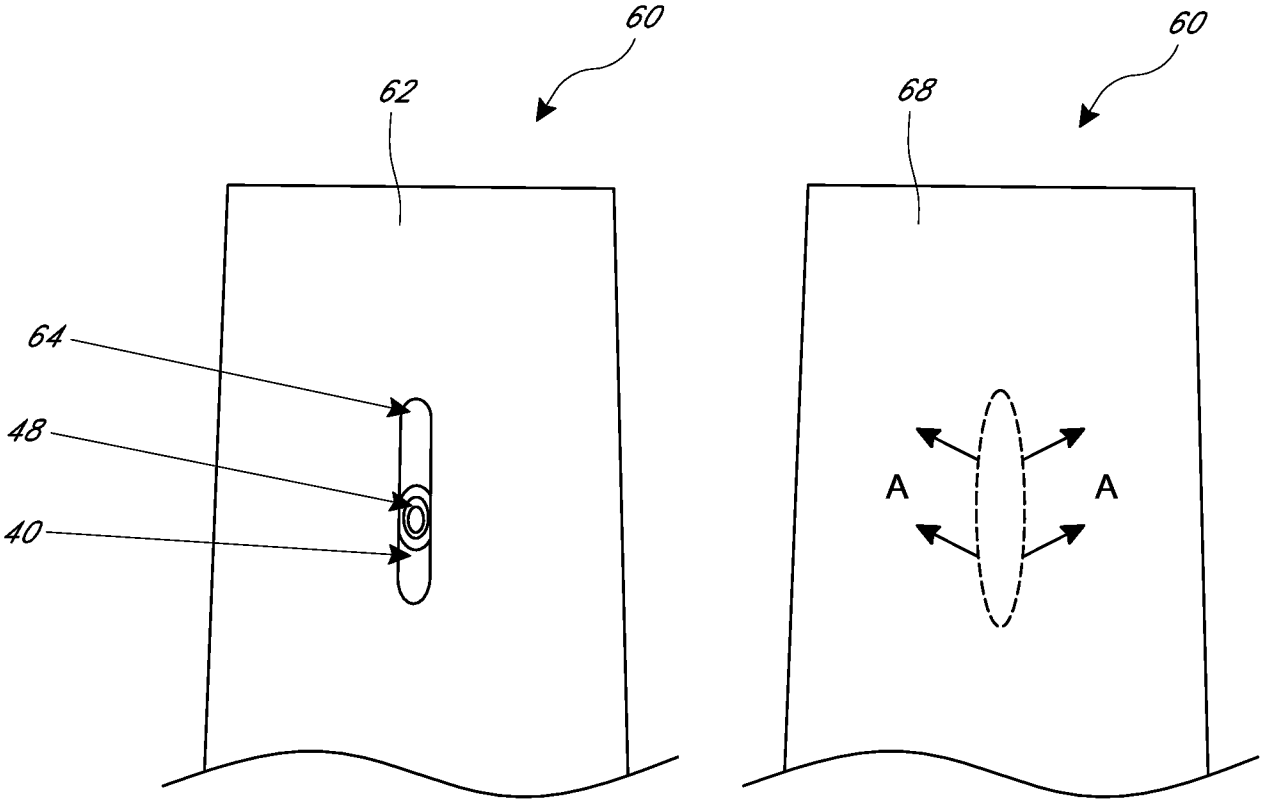
FIG. 5 illustrates different top perspective views of the intermediate support member or interlay component of FIG. 4 secured to the foundation or lower support member of FIG. 3, according to one embodiment.

FIG. 5 illustrates a perspective top view of one embodiment of the intermediate support member, inlay or interlay component 60 positioned and secured relative to a foundation 40. As shown, the slotted openings or cavities 64 of the intermediate support member 60 can generally align with (e.g., at least longitudinally) one or more of the fluid passages 48 of the lower support member or foundation 40. Thus, a slotted opening 64 can be in fluid communication with a fluid passage 48 and the fluid module to which the fluid passage is fluidly coupled. Accordingly, air or other fluid delivered by the fluid modules can be advantageously transferred to one or more of the slotted openings or passages 64 of the intermediate support member, interlay or inlay 60.

With continued reference to FIG. 5, and as noted above, the intermediate support member 60 can comprise an air permeable upper section 68 to effectively cover the slotted openings or passages 64 of the member 60. As shown schematically in FIG. 5, air A or other fluid can pass from the passages 64 through the upper section 68 and exit toward the top of the intermediate support member 60 (e.g., to and through one or more fluid openings or passages of the upper portion or mattress 20. For example, the mattress 20 (see, for example, FIGS. 19A, 19B and 20, and/or various embodiments of a mattress or upper portion disclosed in the patents and publications incorporated by reference herein) can include one or more fluid openings that pass at least partially through the mattress's internal structure. For example, one or more fluid passages or openings can extend from the bottom of the mattress or upper portion 20 to one or more fluid distribution members (e.g., spacer fabrics, spacer materials, etc.) located at or near the top of the upper portion.

The upper portion can comprise one or more materials to provide the desired or required firmness, feel, comfort and/or other characteristics to the bed assembly 10. For example, the bed 10 can include one or more layers of foam (e.g., viscoelastic foam, polyurethane foam, coconut foam, memory foam, other thermoplastics or cushioning materials and/or the like), latex, other thermoplastic materials, pillow layers, other comfort layers and/or the like. In some embodiments, the bed comprises springs (e.g., coil springs, air springs, etc.), air or fluid tubes or containers and/or any other component, device or feature.

Figure 6:
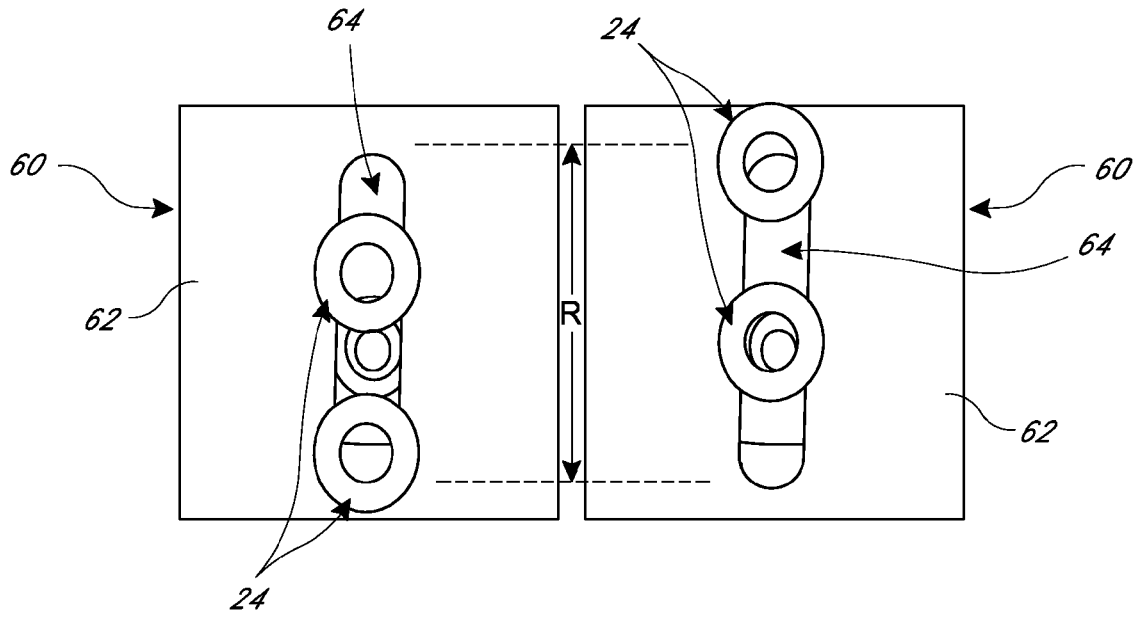
FIG. 6 illustrates different views of fluid passage openings of a mattress or other upper portion of the climate controlled bed of FIGS. 1 and 2 in relation to corresponding fluid openings and passages of the primary and secondary foundations (e.g., a foundation and an interlay component)

FIG. 6 illustrates different top views of an internal passage 24 of the upper portion or mattress 20 as it traverses along, and relates to the slotted openings or passages 64 of the intermediate support member 60. As shown, in some configurations, the internal passage 24 generally aligns with the openings or passages 64. For clarity, only the internal passage 24 (e.g., the inlet of the internal passage at or near the bottom of the upper portion 20) is illustrated in FIG. 6. For additional clarity, the air permeable upper section or cover 68 is also not shown in FIG. 6. As shown, the location of the internal passage 24 can vary as the position of the adjustable bed assembly 10 is modified during use (e.g., as the bed is reclined or otherwise manipulated by an occupant). In some embodiments, the position of one or more internal passages 24 of the mattress or upper portion 20 can vary over a specific range R during use. In some embodiments, the range R is between about 1 to 12 inches (e.g., 1, 2, 3, 4, 5, 6, 7, 8, 9, 10, 11, 12 inches, values between the foregoing, etc.). However, in other embodiments, the range R can be less than about 1 inch or greater than about 12 inches (e.g., 14, 16, 18, 24 inches, more than 24 inches, etc.), as desired or required.

Accordingly, the internal passage(s) 24 of the upper portion or mattress 20 can remain in fluid communication with the slotted opening or cavity 64 of the intermediate support member and the fluid passage or opening 48 of the lower support member 40. Thus, air or other fluid can be continuously delivered to the upper portion 20 of the bed assembly 10 while the adjustable bed is in use (e.g., even while the bed is being adjusted).

Additional Interlay or Inlay Embodiments

Figure 7A:
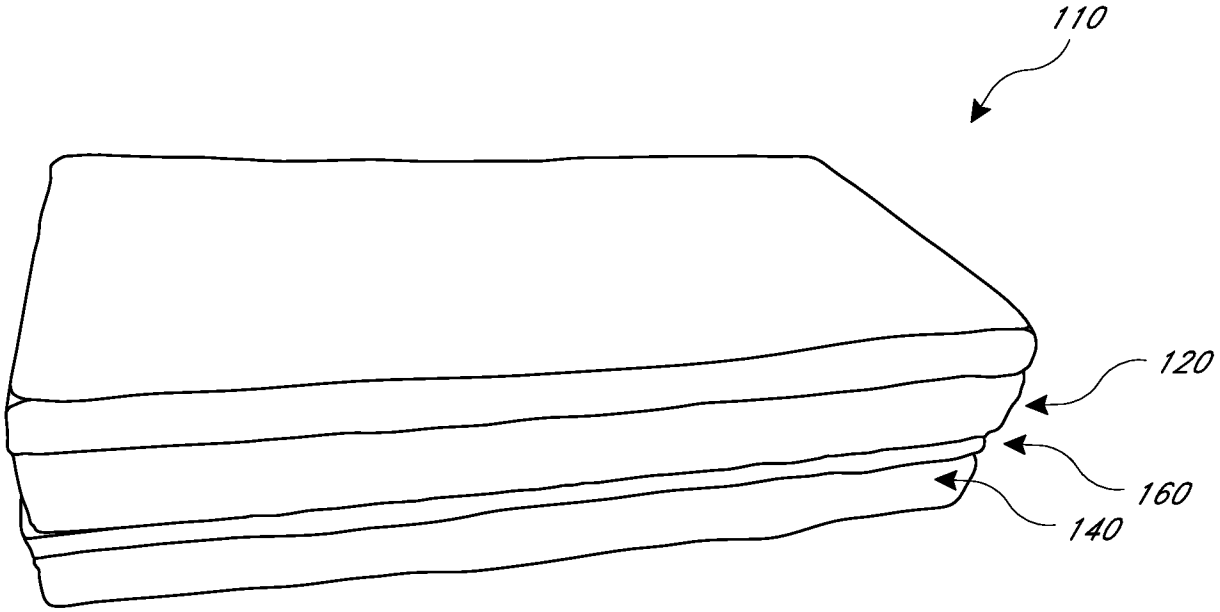
FIG. 7A illustrates a perspective view of one embodiment of a stationary climate controlled bed comprising an interlay component.
Figure 7B:
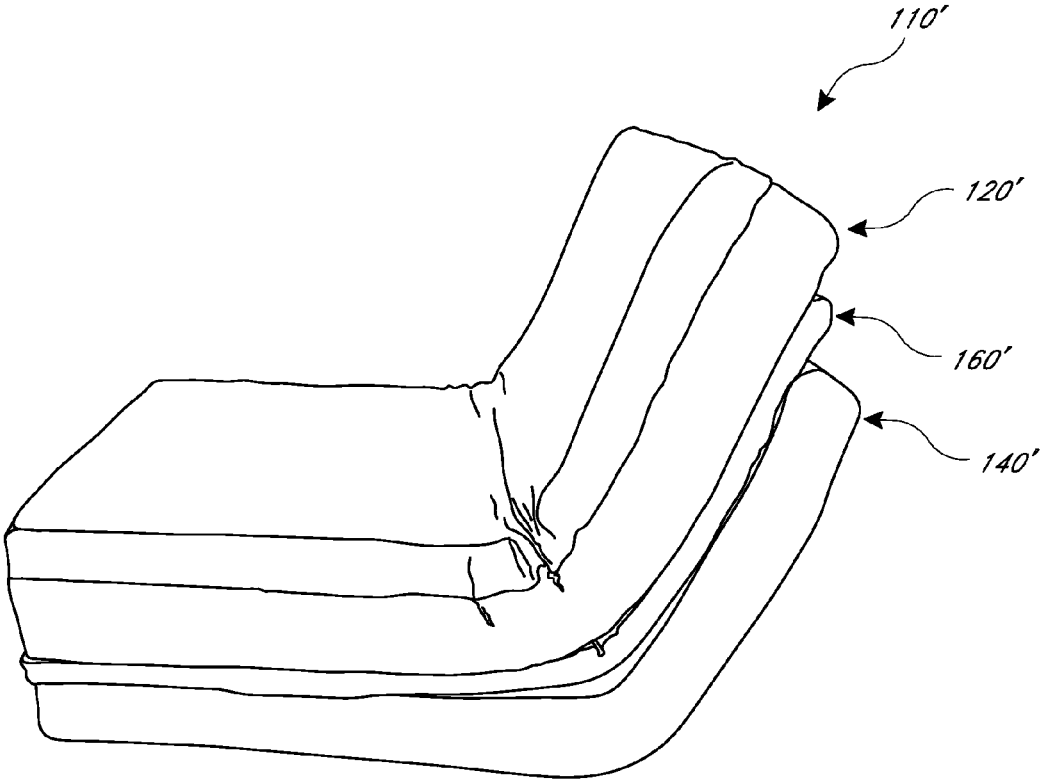
FIG. 7B illustrates a perspective view of one embodiment of an adjustable or reclinable climate controlled bed comprising an interlay component.

In some embodiments, as illustrated in FIGS. 7A and 7B, one or more intermediate layers or inlay components 160, 160' can be strategically positioned between an upper portion or mattress 120, 120' and a lower portion or foundation 140, 140'. In some embodiments, such an intermediate layer 160, 160' is incorporated into any type of stationary bed 110 (e.g., FIG. 7A), adjustable, reclinable or otherwise movable bed 110' (FIG. 7B) and/or any other type of climate controlled seating assembly (e.g., vehicle seat, office chair, sofa, other type of seat or chair, etc.). In any of the embodiments disclosed herein, the inlay or interlay component(s) can be attached to one or more other portions or components of the bed assembly (e.g., the adjacent foundation, other frame, mattress or upper portion, etc.) or it can be separate and unattached to other portions or components of the assembly, as desired or required.

In some embodiments, as disclosed herein, an intermediate layer comprises one or more fluid channels or ducts (e.g., for receiving and moving air, other gases and/or other fluids to specific locations of the bed or other seating assembly), spaces configured to receive and house a fluid module (e.g., a blower or other fluid transfer device, a thermoelectric device, convective heater and/or any other heating, cooling or ventilation device, etc.), wiring, wire harnesses and/or other electrical components, sensors and/or the like. In any of the embodiments disclosed herein, a fluid module can comprise one or more portions. For example, in some arrangements, the blower, fan or other fluid transfer device can be included within a single housing or enclosure with one or more other components (e.g., a thermoelectric device, a convective heater, another type of thermal conditioning device, a controller, one or more sensors, etc.). Alternatively, however, two or more components of a fluid transfer and conditioning system can be separated (e.g., not positioned within a single housing or enclosure). For instance, the blower or fluid transfer device can be in a first housing or enclosure, while the thermal conditioning device (e.g., thermoelectric device, convective heater, etc.) is set apart from the blower. In such embodiments, the components can be placed in fluid communication with one another via one or more conduits, channels, ducts, passages and/or the like, as required.

The use of an intermediate layer in a climate controlled bed or other seating assembly can offer one or more advantages related to the manufacture and/or use of the bed or other seating assembly. For example, an intermediate layer that houses a fluid module, fluid ducts or channels and/or other components of a climate or environmental conditioning system can simplify the design, manufacture, assembly, transport and/or other aspects of the environmentally-conditioned bed or other seating assembly. Further, the intermediate layer or interlay component can be used to advantageously house (e.g., at least partially) the fluid module, ducts or fluid channels, wire harnesses, wiring, power supplies, controllers, sensors and/or other components without the need for install such items in adjacent portions of the bed or other seating assembly (e.g., lower support, upper portion or mattress, etc.). In some embodiments, such configurations can permit a climate controlled bed assembly with limited space (e.g., limited space below the mattress or upper member, limited space around or near the assembly, etc.) to accommodate one or more fluid modules. In addition, such configurations can reduce the overall noise and/or vibration associated with operating the fluid modules (e.g., blower or other fluid transfer device).

FIG. 7A illustrates one embodiment of a fixed climate controlled bed assembly 110 comprising an intermediate, interlay or inlay layer or component 160 generally positioned between the lower support 140 (e.g., slotted or fixed foundation, box spring, other frame or support portion, etc.) and an upper portion (e.g., a mattress, upper cushion, etc.). As noted above, the terms intermediate layer, interlay layer or interlay, inlay layer or inlay are used interchangeably herein. Alternatively, as shown in the embodiment of FIG. 7B, an intermediate layer 160' can be similarly incorporated into an adjustable or otherwise movable bed assembly 110'. One or more features of the adjustable bed discussed with reference to FIGS. 1-6 can be incorporated into other adjustable beds or seating assemblies disclosed herein. Such intermediate or inlay layers can be included in any other type of bed or seating assembly or component, for example, a sofa, a chair, a seat, a futon, a bed topper and/or the like.

In any of the embodiments disclosed herein, the intermediate or inlay layer includes one or more fluid channels configured to permit fluid (e.g., heated, cooled or ventilated fluid discharged by a fluid module, waste fluid, etc.). Accordingly, such channels or other passages are in fluid communication with one or more fluid modules. In any of the embodiments disclosed herein, a fluid module can include a fluid transfer device (e.g., fan or blower), a thermal conditioning device (e.g., a thermoelectric device, a convective heater, another type of fluid heating or cooling device, etc.), one or more sensors (e.g., temperature sensors, humidity sensors, condensation sensors, etc.), controllers and/or the like. In some embodiments, the blower or other fluid transfer device is included within a single housing as a thermal conditioning device and/or one or more other components of the module. Alternatively, however, the blower or other fluid transfer device can be separated from one or more other components of the fluid module (e.g., a thermoelectric device, convective heater or other thermal conditioning device). In such embodiments, one or more ducts, conduits or other fluid lines can be used to deliver air or other fluid from the fluid transfer device to, near or past the thermal conditioning device and/or other components of the fluid module.

Further, as noted and illustrated in some of the embodiments disclosed herein, the intermediate layer or inlay can be shaped, sized, designed and otherwise configured to accommodate one or more fluid modules directly therein. Such a configuration can provide one or more benefits and other advantages to the climate controlled seating assembly, such as, for example, space saving advantages, simplification of the assembly's overall design, quieter, smoother and/or otherwise more enhanced or improved operation of the system (e.g., reduced noise and/or vibration created by the operating fluid modules, better fluid transfer to, through and away from the assembly, etc.) and/or the like. Alternatively, however, one or more fluid modules are not located within or near the intermediate layer or inlay, requiring fluid from such fluid modules to be routed to one or more inlets of the channel(s) of the intermediate layer or inlay. Regardless of its exact orientation, configuration and overall design, the intermediate layer or inlay can receive and strategically route inlet air and/or air discharged by one or more fluid modules (e.g., heated, cooled or ventilated fluid intended to be delivered through one or more openings of the adjacent mattress or upper layer toward a seated occupant). The channels of the intermediate layer or inlay can also be used to receive and strategically route other fluid streams created by the fluid modules. For example, the inlay can comprise one or more channels that receive and route to select portions of the inlay, and thus the seating assembly, waste air created by one or more thermoelectric devices or other thermal conditioning devices of the assembly's climate control system. As discussed in greater detail herein, the intermediate layer or inlay can also be used to strategically and advantageously accommodate one or more wire harnesses for placing the fluid modules and/or other electric components of the system in power and/or data communication with a power supply, controller and/or the like.

According to some embodiments, the fluid channels of the intermediate layer or inlay of a bed or other seating assembly are configured to selectively route thermally conditioned (and/or ventilated) air or other fluid to one or more fluid inlets of the adjacent mattress or upper portion of the bed or other seating assembly. Accordingly, fluid can be delivered through the mattress or other upper portion of the assembly and toward one or more seated occupants.

Figure 8:
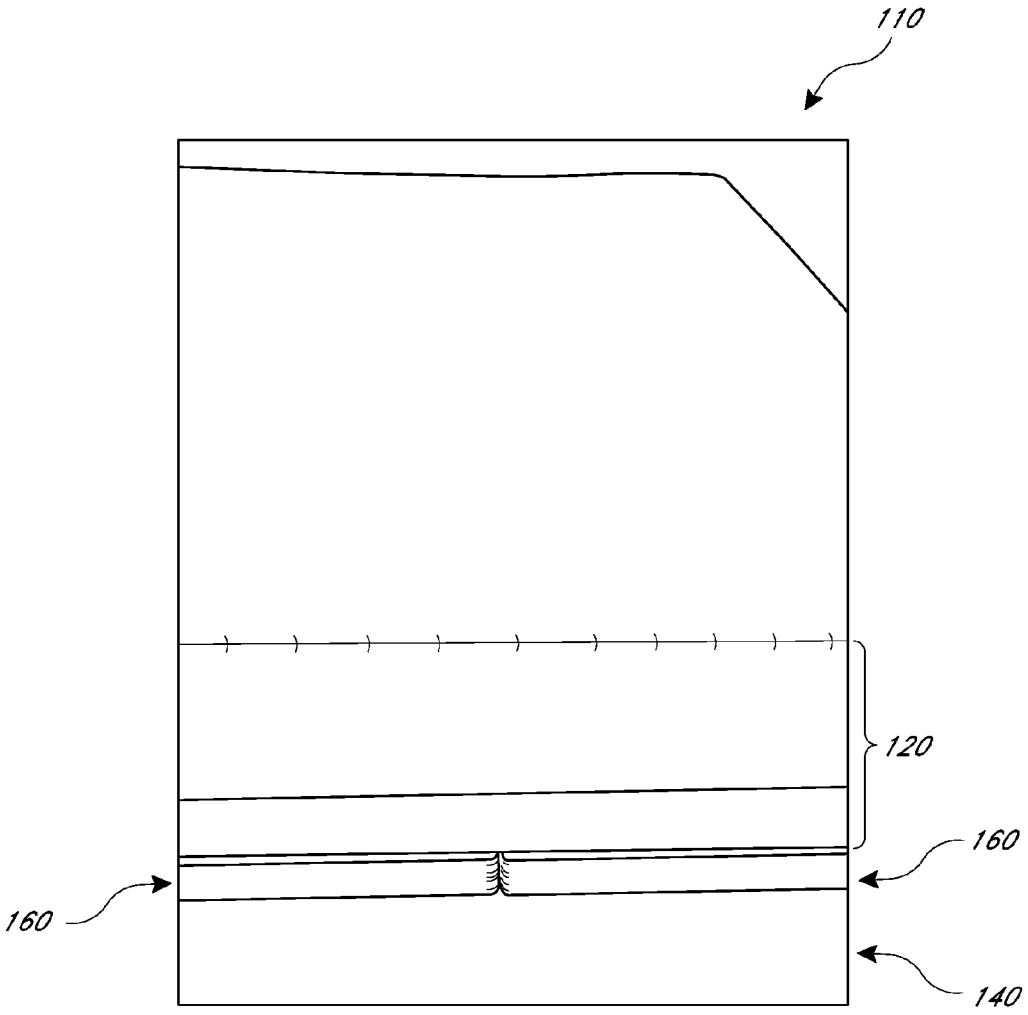
FIG. 8 illustrates a partial perspective view of one embodiment of a climate controlled bed comprising one or more interlay components.

FIG. 8 illustrates a front perspective view of a climate controlled bed (e.g., a fixed bed) 110 that comprises one or more intermediate layer or inlays. In the depicted embodiment, for example, there are two separate inlay components 160 positioned between the mattress or upper portion 120 and the foundation or lower portion 140 of the bed. As with other climate controlled bed configurations disclosed herein, the assembly 110 of FIG. 8 includes two equally sized or substantially equally sized inlay components 160, each of which is sized, shaped and configured to span across half or substantially half of the bed's surface area. For example, each inlay component 160 can cover the left or right portion of the bed (e.g., the area associated with one of the occupants of a bed, futon, sofa or other seating assembly). In other embodiments, however, the intermediate layer or inlay 160 can include more (e.g., three, four, more than four, etc.) or fewer (e.g., only one) components, depending on the size of the bed or other seating assembly and/or as otherwise desired or required.

Figure 9:
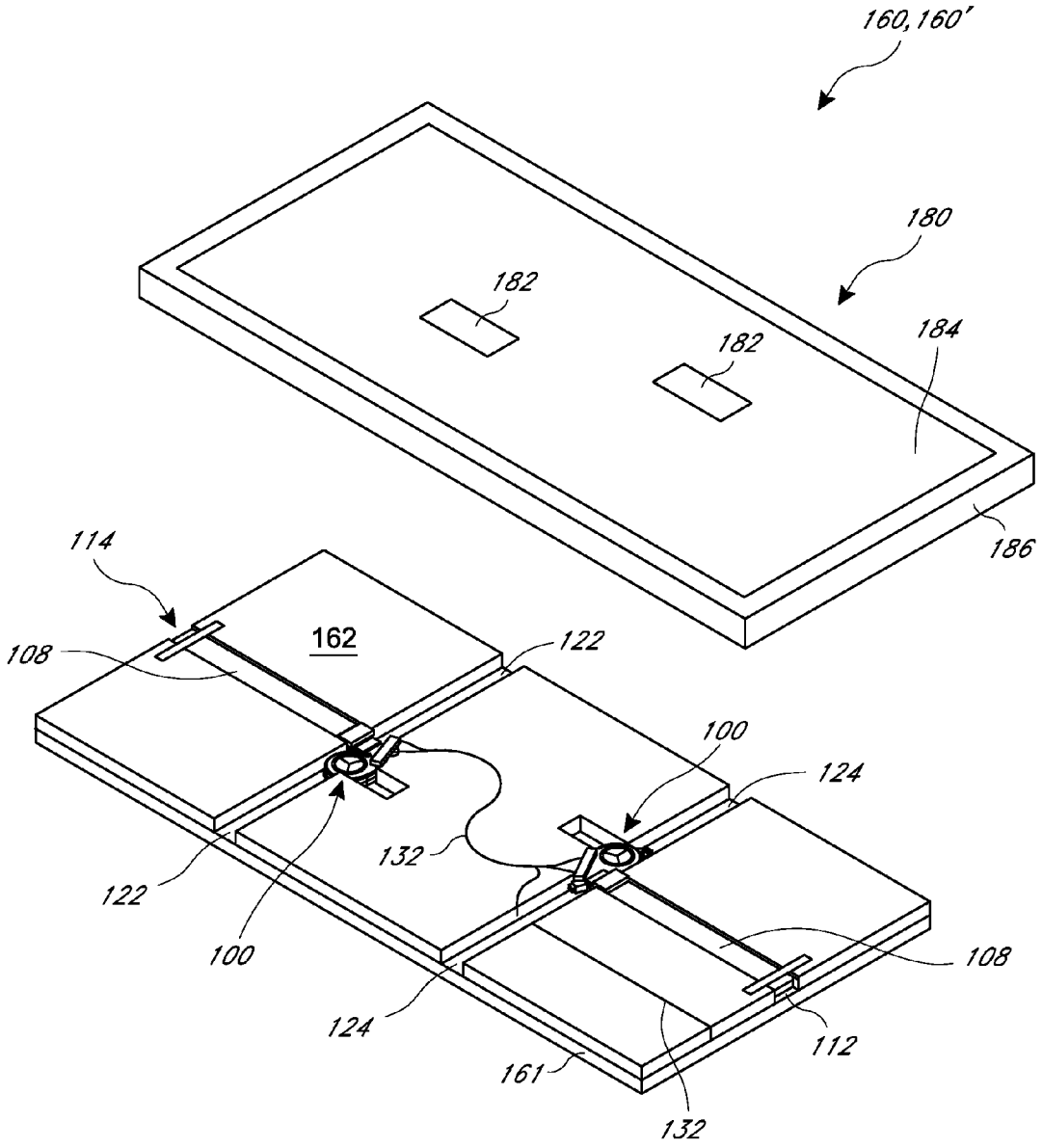
FIG. 9 illustrates an exploded top perspective view of one embodiment of an interlay or inlay component configured for use in a climate controlled bed.

One embodiment of an intermediate layer, interlay or inlay 160, 160' configured for use in a climate controlled seating assembly (such as the fixed or adjustable beds of FIGS. 7A and 7B, respectively) is illustrated in FIG. 9. As shown, the inlay 160, 160' (or a component thereof) can comprise one or more fluid modules 100. Therefore, for a bed assembly that includes two inlay components, such as the one illustrated in FIG. 8, a total of four fluid modules are used. The depicted embodiment of the inlay component comprises a total of two fluid modules, spaced apart from one another. In other embodiments, the quantity, location, orientation, spacing and/or other details regarding the fluid modules can vary, as desired or required. For example, an intermediate layer or inlay can include fewer (e.g., one) or more (e.g., three, four or more) fluid modules, depending on the size of the bed or other seating assembly, the desired environmental conditioning and/or one or more other factors or considerations.

With continued reference to FIG. 9, the intermediate layer or inlay 160, 160' can include one or more inlet channels 122, 124 through which ambient air or other fluid is drawn toward the intake or inlet of the module's blower, fan or other fluid transfer device. In the illustrated embodiment, the inlet channels 122, 124 extend laterally from one side end of the intermediate layer 160, 160' to the other end. In such an arrangement, therefore, at least part of the air that is transferred by the fluid modules is drawn toward the inlet of the fluid module from both the left and right sides of the layer 160, 160'. In other embodiments, however, the inlet channels can be routed along a different portion of the intermediate layer or inlay 160, 160' (e.g., the head-side or foot-side of the layer), either in lieu of or in additional to the sides, as desired or required. In the various embodiments disclosed herein, the channels or passages of the interlay or inlay components comprise a generally rectangular cross-sectional shape. However, the cross-sectional shape of the channels can vary (e.g., semi-circular, partially oval or circular, triangular, other polygonal, irregular, etc.), as desired or required. Further, in any of the embodiments disclosed herein, one or more of the channels can include a lining, coating and/or other feature thereon (e.g., to improve air impermeability, reduce head loss and/or for any reason, purpose or goal).

In some embodiments, and for any of the bed or other seating assemblies disclosed herein, only a portion of the air that is delivered to the fluid modules originates from the inlet channels of the inlay or interlay component 160, 160'. For example, at least some or even a majority of the volume of inlet air that is transferred by the fluid modules can come from the space underneath the interlay component (e.g., from the foundation or other area below the interlay component and through the windows or openings 182 along the rear side of the inlay component). In fact, in some embodiments, the inlet channels 122, 124 of the inlay are configured to serve merely as supplemental conduits of inlet air. In some arrangements, one reason for this is because the edges of the interlay inlet channels can become blocked, at least partially, by blankets, sheets or other portions of a bed or other items placed adjacent to the bed (e.g., chests, other furniture, etc.). Thus, the bottom of the bed assembly can provide a more reliable and consistent source of inlet air to the fluid modules.

With continued reference to FIG. 9, the interlay or interlay component 160, 160' comprises one or more recesses that are sized, shaped and otherwise configured to accommodate fluid modules. Such recesses or portions of the interlay component are advantageously designed so that when a fluid module is positioned therein, the inlets of the fluid modules are generally aligned and/or otherwise placed in fluid communication with the inlet channels 122, 124 of the interlay and/or other inlet openings (e.g., windows or other accessways 182 along the rear side of the interlay). In any of the embodiments disclosed herein, the inlay or interlay components can comprise one or more flexible, rigid and/or semi-rigid materials, such as, for example, foam (e.g., open cell foam, closed cell foam, etc.), other plastic materials, metals, alloys, other composite or natural materials, etc.). For example, the interlay can be configured to be generally flexible within a desired range for use in adjustable beds or other movable seating assemblies. In addition, the interlay components can be air permeable (partially or completely) or air impermeable, as desired or required.

Figure 11:
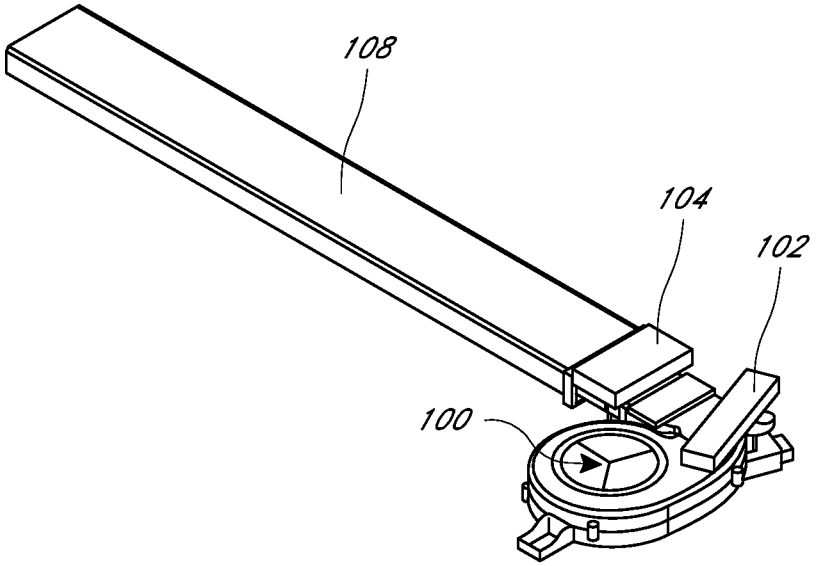
FIG. 11 illustrates a perspective view of one embodiment of a fluid module assembly configured for use with an interlay or inlay component of a climate controlled bed.

According to some embodiments, as illustrated in FIG. 11, the fluid modules 100 that are positioned within the interlay component 160, 160' are provided as part of a larger module assembly. For example, the depicted assembly comprises a fluid module 100 (e.g., blower or other fluid transfer device, thermoelectric device, convective heater or other thermal or environmental conditioning device, etc.) and a duct or other fluid conduit 108 in fluid communication with an outlet (e.g., the waste outlet) of the module. The module assembly can also include one or more guides or separation members 102, 104 that are configured to provide a necessary or desired clearance between the fluid module and the bottom of the interlay component once the assembly has been properly positioned within the interlay and the interlay has been placed between a foundation and a mattress or other upper portion. The module assembly illustrated in FIG. 11 can be sized, shaped and otherwise configured to be placed within a corresponding module recess, channel recess and/or other portion of the interlay component, as shown in FIG. 9. However, in other embodiments, one or more fluid modules 100 can be positioned directly into the inlay or interlay component 160, 160'.

Regardless of their exact design and other details, fluid modules 100 having a waste stream (e.g., such as fluid modules that comprise one or more thermoelectric devices or similar heating or cooling devices) can be configured to discharge such a waste stream in one or more waste conduits or channels 112, 114 of the inlay or interlay component. As illustrated in the embodiment of FIG. 9, the waste streams of the fluid modules 100 are directed to the head-end and foot-end of the bed via corresponding waste channels 112, 114. In other embodiments, however, the waste channels are directed to one or more other locations of the bed or other seating assembly (e.g., one or more of the side edges, only the head-end, only the foot-end, etc.), as desired or required.

With continued reference to FIG. 9, the inlay or interlay component 160, 160' can comprise one or more slots 132, gaps, recesses or other spaces configured to accommodate wire harnesses, wires, other electrical connections, sensors, struts or other structural reinforcing members and/or any other device or component. Such openings 132 can allow for wire harnesses, other electrical connectors and/or any other device or member to be neatly and discretely positioned in the inlay component (e.g., to provide power to the fluid modules, to place the fluid modules, components thereof and/or other components, such as, sensors, controllers and/or the like in data communication with one another or with other portions of the assembly's climate control system, etc.).

According to some embodiments, the channels, wire harness slots, fluid module recesses and/or other openings of the inlay component 160, 160' are manufactured into the desired shape using molding techniques (e.g., injection molding). Alternatively, however, such openings can be created by selectively removing portions of a base material (e.g., larger foam block or layer). In other embodiments, one or more layers or portions can be selectively attached to a base layer 161 so as to create the channels 122, 124, 112, 114, recesses, slots 132 and/or other openings within the inlay component, as desired or required. For example, smaller foam components can be secured to one or more base foam layers 161 using adhesives, fasteners and/or any other type of connection method or device.

Figure 10A:
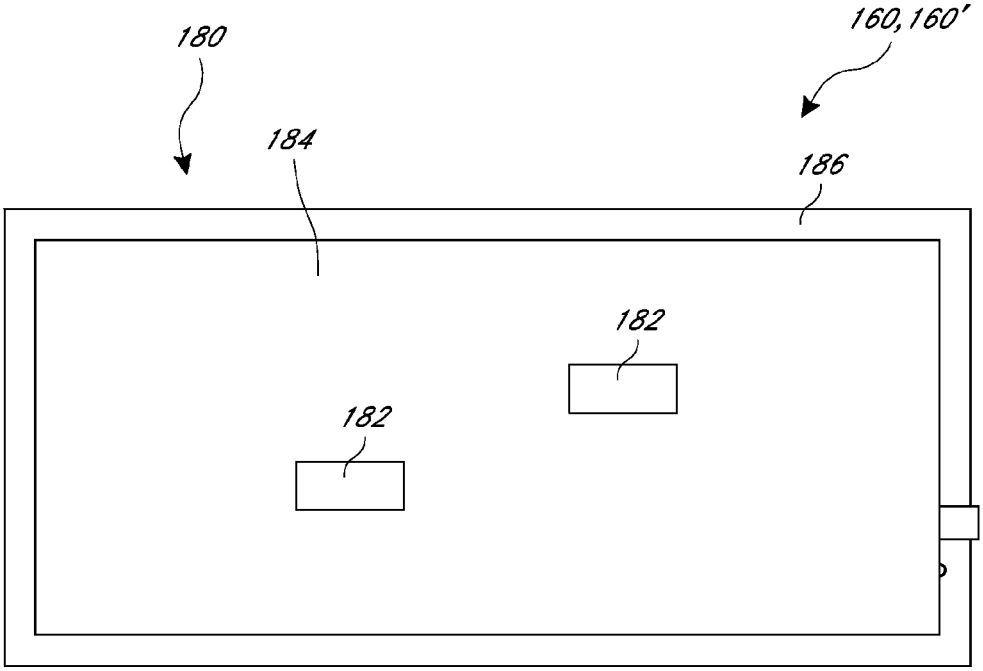
FIGS. 10A and 10B illustrate bottom and top views, respectively, of the interlay or inlay component of FIG. 9.

As illustrated in FIGS. 9 and 10A, one or more coverings or outer layers 180 can be positioned at least partially along the outside of the inlay or interlay component 160, 160'. In the depicted embodiment, a generally air impermeable or partially air impermeable layer 184 (e.g., fabric, coating, etc.) is positioned along the lower side of the inlay component. In some arrangements, such a layer 184 comprises an anti-skid or anti-slip layer that helps to maintain the position of the inlay component relative to the foundation on which it is positioned after assembly and during use. As noted herein, the layer can include one or more windows or other openings 182 that are aligned (at least partially) with the fluid modules to advantageously permit inlet air to be transferred to the fluid modules from an area below the inlay component 160, 160' (e.g., within or near the foundation).

Figure 10B:
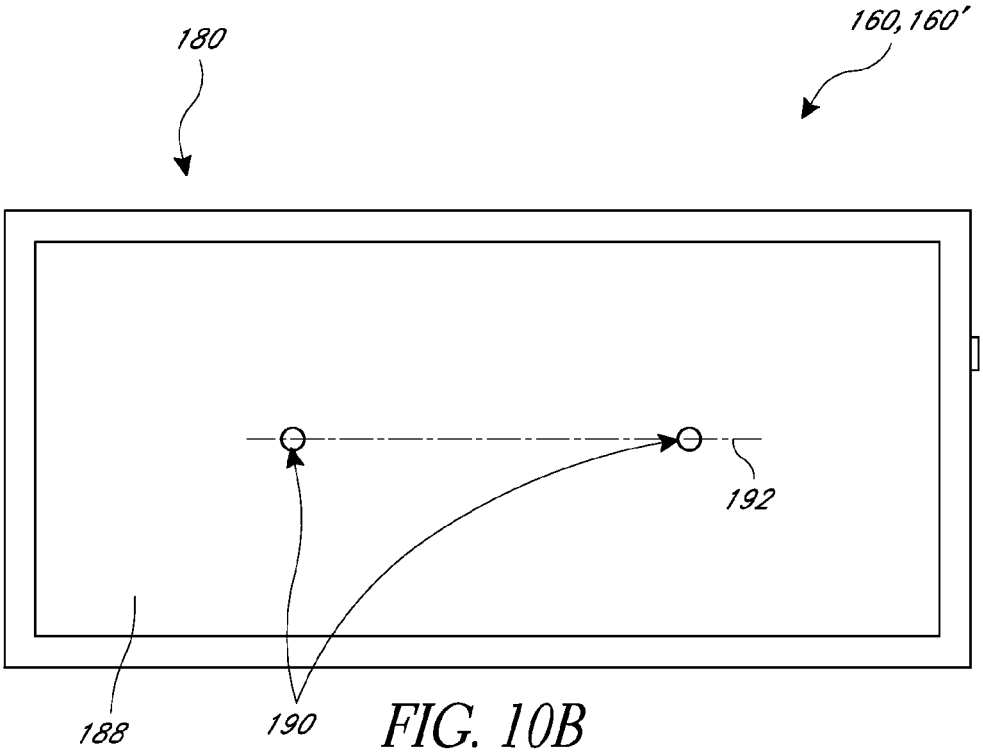

With reference to the top view of the inlay component illustrated in FIG. 10B, the top surface 188 of the component 160, 160' can also include one or more non-skid layers to help maintain the position of the inlay component relative to the mattress or upper portion of the bed assembly. Further, the discharge end 190 of each of the fluid modules 100 included within the inlay component can be directed to corresponding outlets 190 that extend to or near (or in some embodiments, through and above) the top of the inlay component (e.g., through one or more layers or other coverings). In some embodiments, such outlets 190 are oriented so as to generally align with internal passages of the adjacent mattress or other upper portion of the bed assembly (see, e.g., FIGS. 19A, 19B and 20). Accordingly, air or other fluid discharged by the fluid modules of the inlay component 160 160' can be advantageously delivered through fluid passages of the mattress and toward the top of the bed assembly (e.g., toward one or more seated occupants through one or more fluid distribution members or portions located along or near the top of the mattress). In the depicted arrangements, the outlets are generally aligned along a longitudinal axis 192 of the inlay. However, in other embodiments, two or more of the outlets can be offset form each other, as desired or required.

Figure 12:
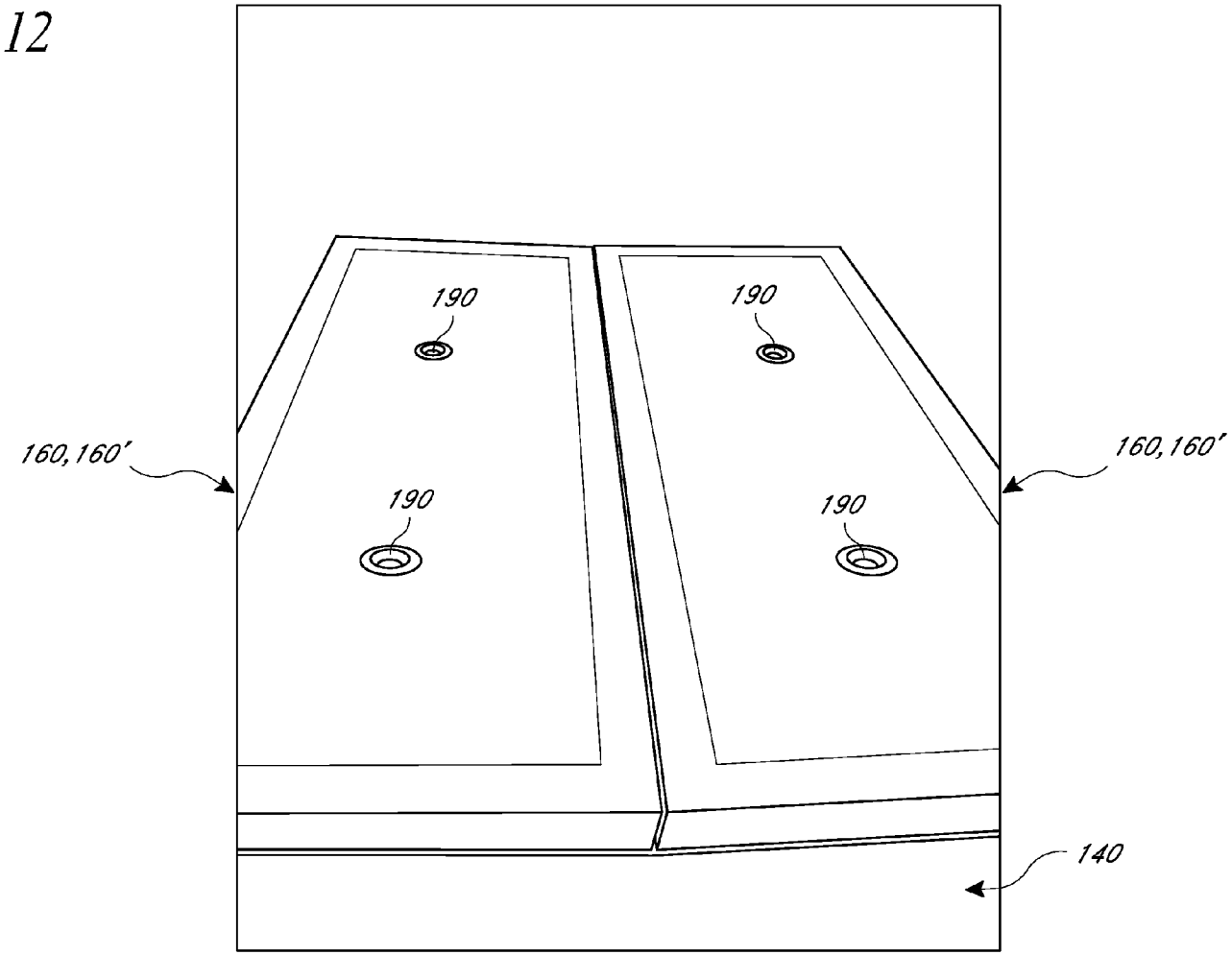
FIG. 12 illustrates a top perspective view of one embodiment of a climate controlled bed comprising two interlay or inlay components positioned immediately next to each other above a foundation.

FIG. 12 illustrates a top perspective view of two intermediate layers, inlay components or interlay components 160, 160' positioned next to one another in a side-by-side orientation. In the depicted embodiment, the inlay components are sized, shaped and otherwise configured to rest on a single foundation or lower portion 140 of a fixed bed, an adjustable bed or any other seating assembly. In other embodiments, the quantity, size, orientation and/or other details of the inlays 160, 160', the foundation 140 and/or any other component of the bed assembly can vary, as desired or required by a particular design or application.

Figure 13:
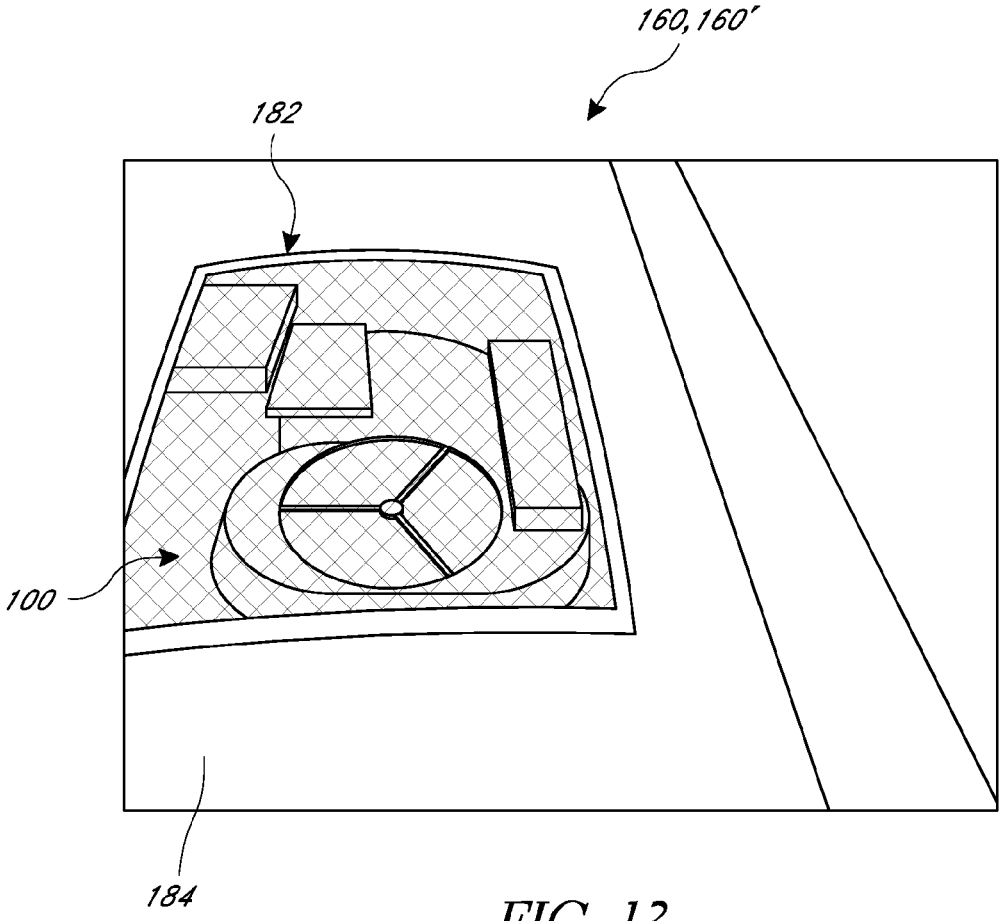
FIG. 13 illustrates a partial bottom view of one embodiment of an interlay or inlay component with a fluid module visible through a window or other opening.

FIG. 13 illustrates one embodiment of a window or other opening 182 along the back or rear side (e.g., bottom, when the inlay is positioned on a bed assembly) 184 of an inlay component 160, 160'. As shown, the window 182 comprises a layer of mesh and/or one or more other air permeable materials or configurations to permit air or other fluid to freely flow from the area beneath the inlay 160, 160' to the inlet of the fluid module positioned within the inlay component. According to some embodiments, the layer or covering along the rear side of the inlay adjacent the window or opening 182 can be completely or partially air impermeable. For example, the layer can comprise a non-skid or anti-skid material to prevent or reduce the likelihood of relative movement between the interlay 160, 160' and the adjacent foundation or frame when the bed assembly is properly assembled and in use. In the depicted embodiments, the windows or other openings along the rear surface of the inlay component are generally rectangular. However, in other arrangements, the shape, size, spacing, orientation or other details related to the windows can vary, as desired or required. For example, the windows 182 can comprise a generally circular, oval, other polygonal (e.g., triangular, pentagonal, hexagonal, etc.), irregular and/or any other shape. For any of the embodiments disclosed herein, any layer or other covering that is positioned completely or partially around a interlay, inlay or intermediate layer or component can be configured to include an air permeable or partially air permeable portion (e.g., permeable fabric or other layer, mesh or other layer comprising one or more fluid openings or passages, etc.) at locations where the channels (e.g., inlet channels, waste channels, etc.) terminate along the ends or edges of the inlay. Such a configuration can allow air to freely enter and/or exit the channels of the inlay.

Figure 14:
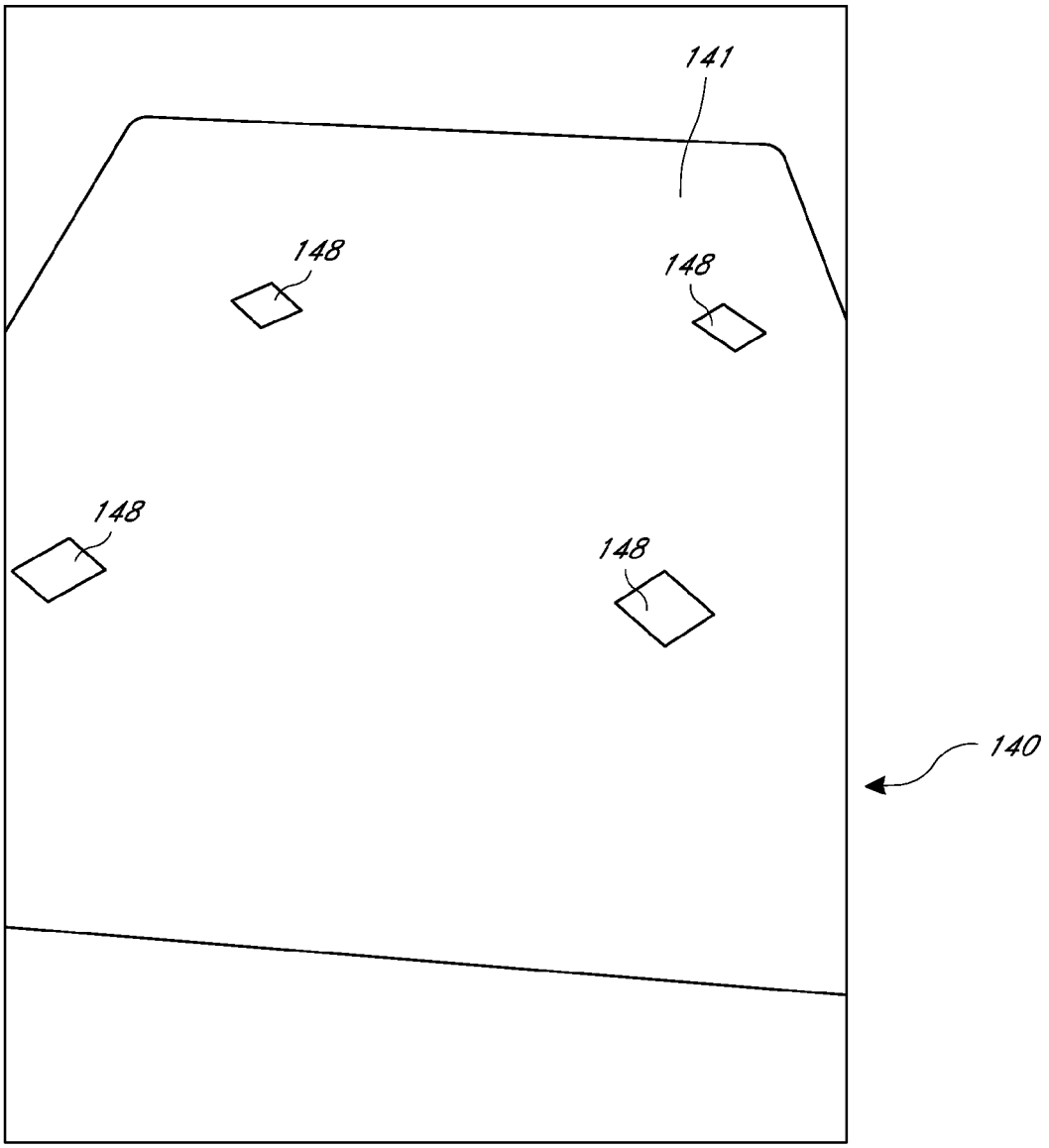
FIG. 14 illustrates a top perspective view of one embodiment of a foundation for a fixed (non-adjustable) bed configured to support one or more interlay or inlay components.

One embodiment of a foundation or lower portion 140 for a bed assembly (e.g., a non-adjustable bed) is illustrated in FIG. 14. As shown, the foundation 140 can comprise a unitary structure that is sized, shaped and otherwise configured to span across the entire area or substantially the entire area of the climate controlled bed assembly. Alternatively, however, the foundation 140 can include two or more components which, when secured to one another or placed in proximity to one another, support the inlay component(s), mattress or upper portion and any other components of the bed assembly. With continued reference to FIG. 14, the top surface 141 of the foundation 140 can include one or more openings 148. In some embodiments, such openings 148 are sized, shaped, located and otherwise configured to align or substantially align with adjacent windows or other openings 182 along the rear surface of the inlay 160, 160'. Accordingly, air or other fluid can be drawn into the fluid modules located within or near the inlay components from the area within, below and/or near the foundation 140.

Figure 15:
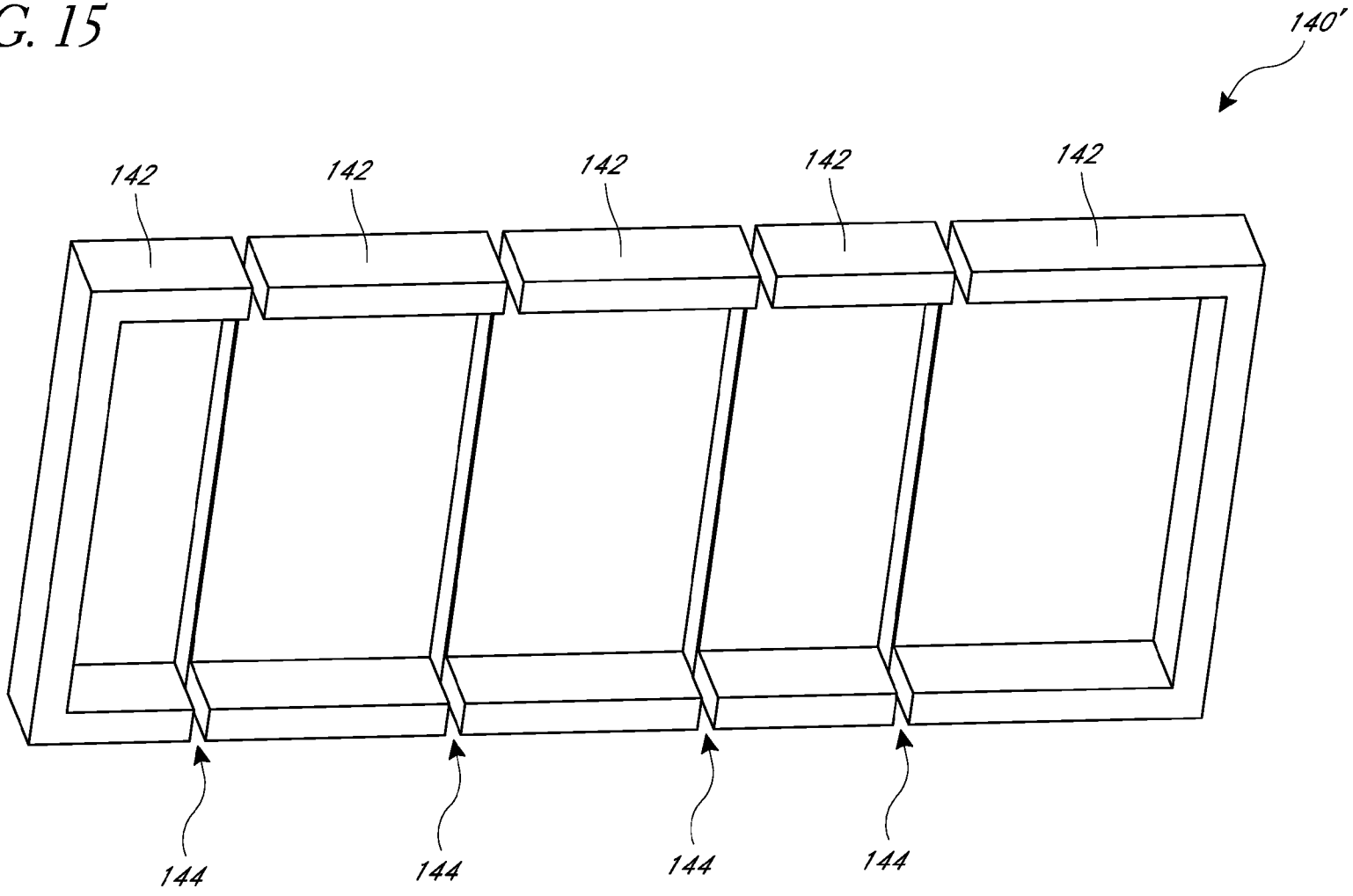
FIG. 15 illustrates a bottom perspective view of one embodiment of a slotted foundation for an adjustable (e.g., reclinable or otherwise movable) bed configured to receive and support one or more interlay or inlay components.

FIG. 15 illustrates a rear, perspective view of a foundation or lower portion 140' configured to be used in an adjustable climate controlled bed assembly. As shown, the foundation 140' can include one or more slots, gaps or spaces 144 that separate adjacent portions or sections 142 of the foundation. In some embodiments, adjacent sections 142 are connected to each other using one or more fasteners (e.g., straps, belts, wires, mechanical fasteners, etc.) that provide the required or desired flexibility to the foundation (e.g., by allowing relative rotation of adjacent sections or portions). Accordingly, the adjustable bed can be permitted to rotate during use as a user changes the angle of the bed. In the illustrated embodiment, the foundation 140' comprises a total of five sections 142, some of which vary in shape. In other arrangements, however, the number, length, spacing, relative angular flexibility and/or characteristics of the adjustable foundation can vary, as desired or required by a particular application or use. The use of a slotted foundation, such as the one illustrated in FIG. 15, can facilitate the delivery of air other fluid from the area within or below the foundation to the fluid modules positioned within one or more interlay or inlay components. For example, the slots or openings of the foundation can be located along or near adjacent windows or openings 182 along the lower surface of an inlay so as to provide access to the corresponding fluid module intake. Such slots can either replace or supplement other openings within a foundation (see, for example, the dedicated openings 148 of the foundation of FIG. 14).

Figure 16A:
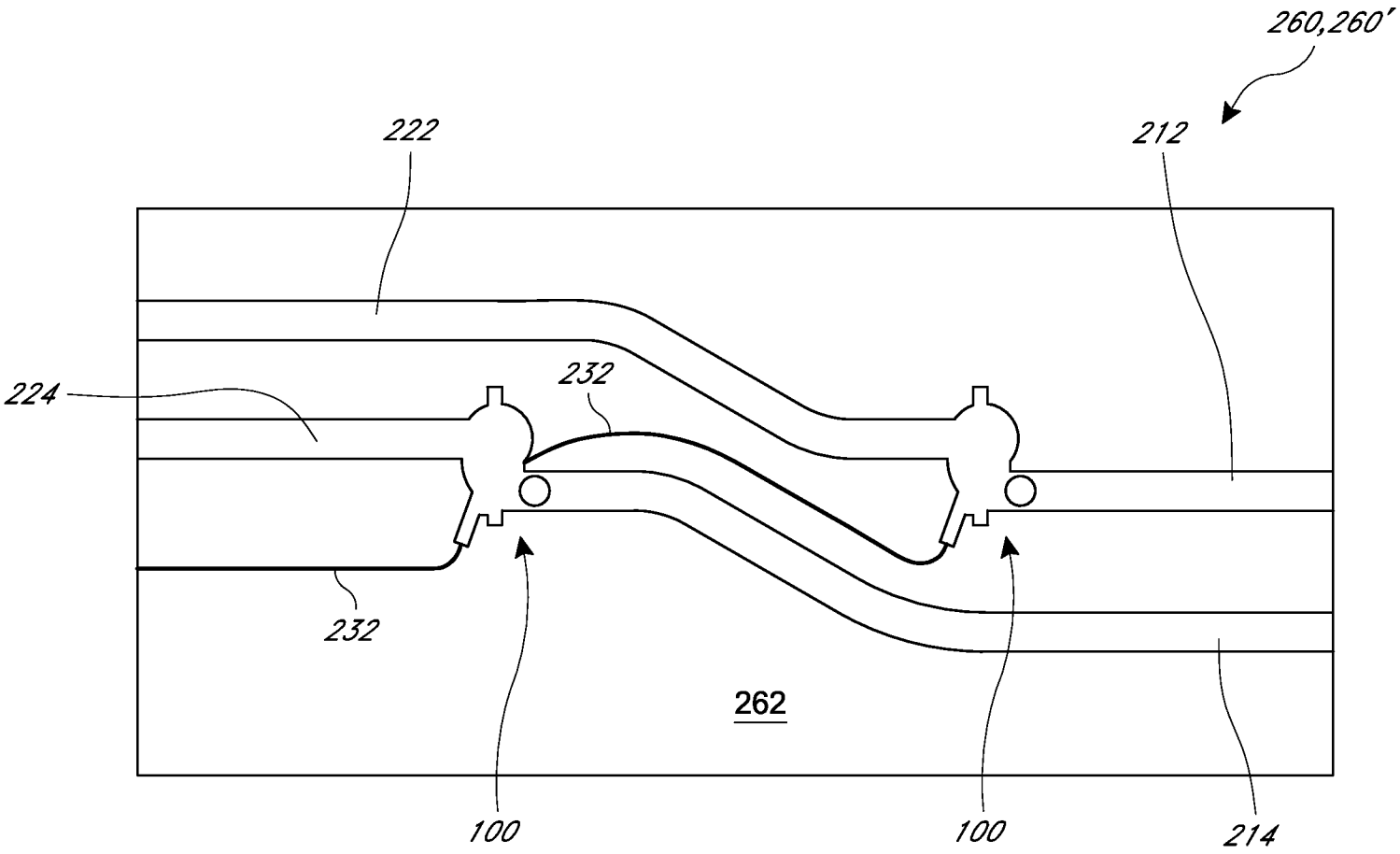
FIG. 16A illustrates a bottom view of an interlay or inlay component configured for use in a climate controlled bed according to another embodiment.
Figure 16B:
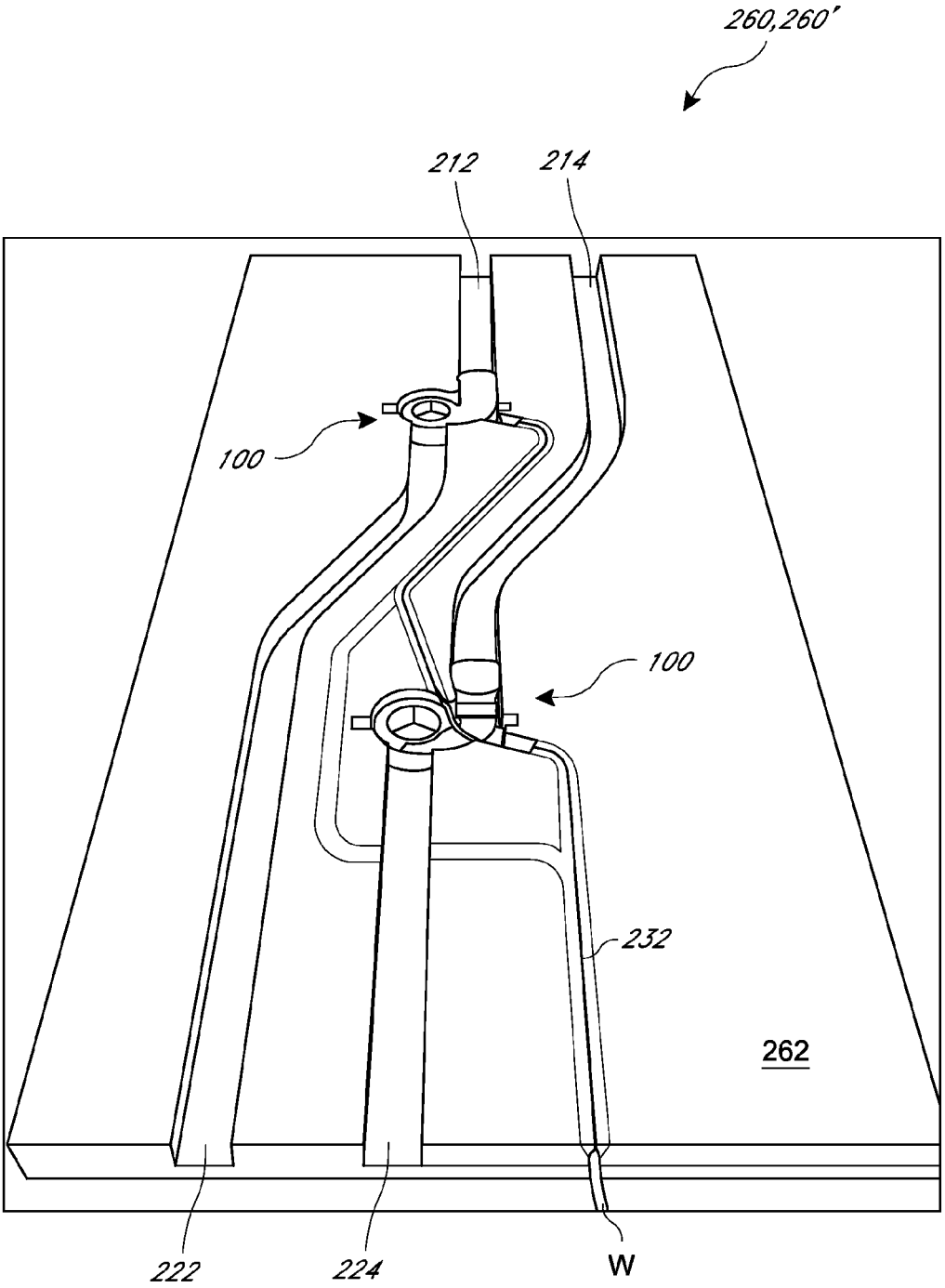
FIG. 16B illustrates a top perspective view of the interlay or inlay component of FIG. 16A.

FIGS. 16A and 16B illustrate different views of another embodiment of an intermediate layer or inlay component 260, 260' configured for use in a climate controlled bed or other seating assembly. As with other inlay configurations disclosed herein, the depicted inlay component 260, 260' can be used either in fixed or adjustable bed assemblies. In the illustrated embodiment, the inlay component 260, 260' comprises two fluid modules 100. Inlet channels 222, 224 formed within the inlay can help deliver ambient air toward the inlet of each fluid module. Such a stream of inlet air can supplement or replace air drawn from any open area beneath the inlay (e.g., through any openings or fluid passages formed within the inlay and/or the foundation below and in the vicinity of the fluid modules 100).

With continued reference to FIGS. 16A and 16B, to the extent that the fluid modules produce a waste stream (e.g., fluid passing through the waste side of a thermoelectric device or other temperature conditioning device having main and waste fluid streams), waste channels 212, 214 formed within the inlay can be used to transfer such waste air to the outside of the inlay and the bed assembly. In the illustrated embodiment, the inlet channels extend to the foot-end of the bed or other seating assembly, while the waste channels extend to the head-end of the assembly. In other arrangements, however, the orientation of the channels can be reversed (e.g., so the waste air is transferred to the foot end of the bed when the fluid modules are in use).

Figure 17:
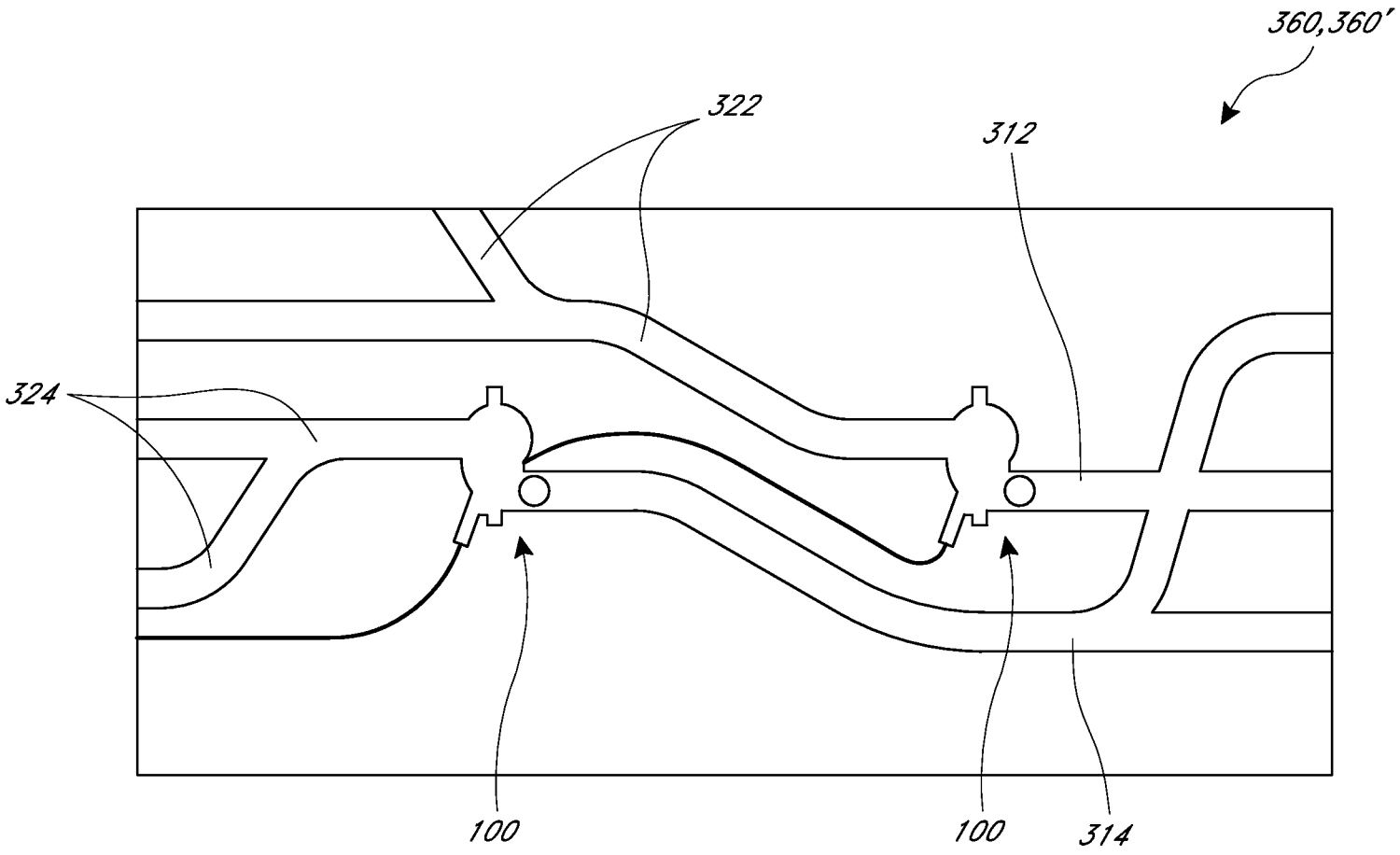
FIG. 17 illustrates a bottom view of another embodiment of an interlay or inlay component configured for use in a climate controlled bed.

In other embodiments, the channels can begin and/or terminate along the sides of the inlay, either in lieu of or in addition to the head-end or foot-end, as desired or required. In yet other arrangements, one or more channels of an inlay can meet, combine or otherwise be placed in fluid communication with one another. By way of example, the inlay embodiment illustrated in FIG. 17 comprises inlet channels 322, 324 that branch off and terminate along two different portions of the inlay edge. For instance, inlet channel 322 extends to both the foot-end and a side of the inlay or interlay component 360, 360'. In addition, the waste channels 312, 314 depicted in FIG. 17 are generally combined (e.g., hydraulically) and extend to three different locations along the head end of the inlay.

Figure 18:
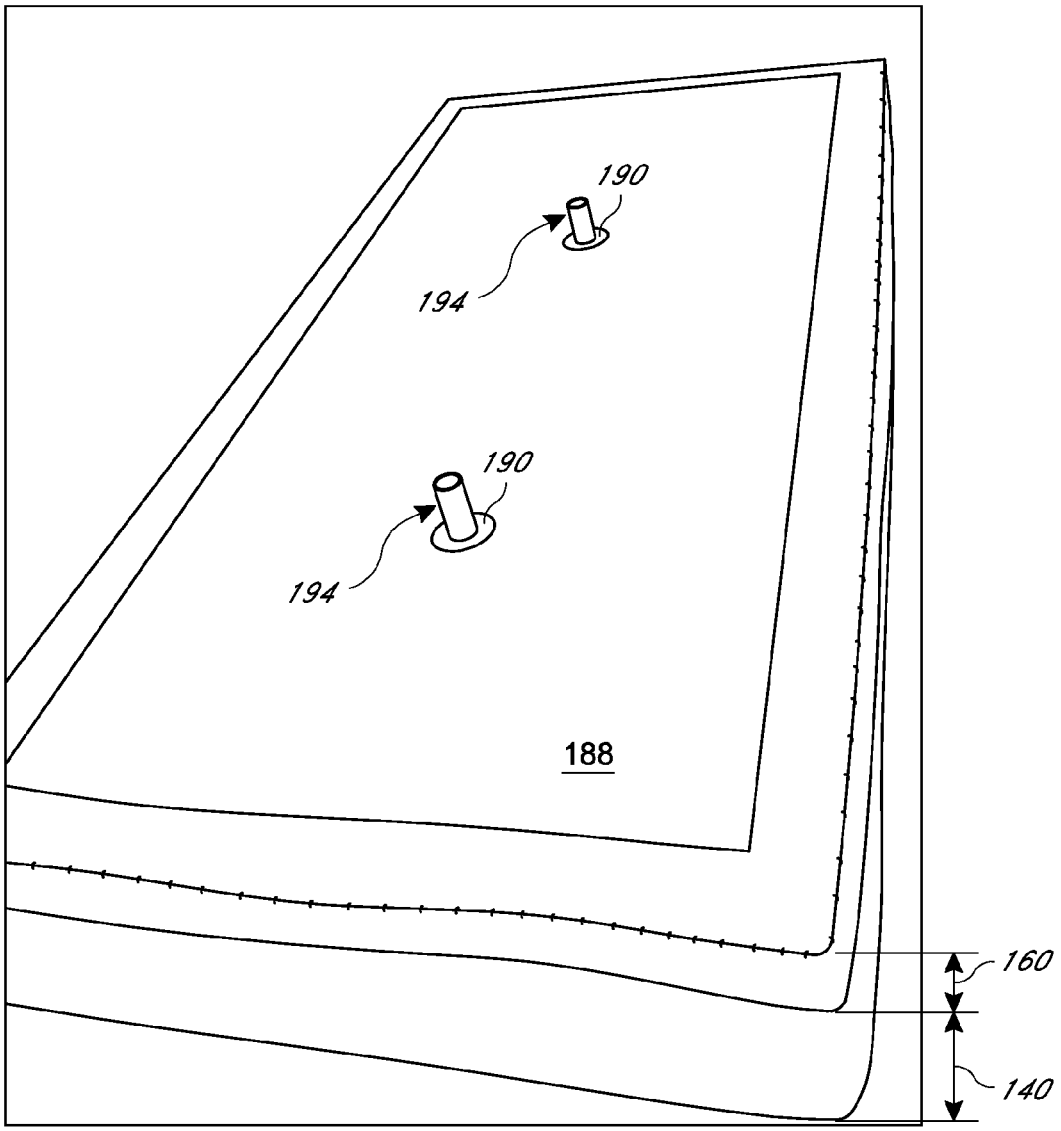
FIG. 18 illustrates a top perspective view of one embodiment of a climate controlled bed having conduits (e.g., couplings, fittings, etc.) positioned at least partially within the openings of the interlay or inlay component.

Regardless of the exact design and configuration of the intermediate layer, interlay or inlay (or a component thereof), the outlets (e.g., discharge ends of the fluid modules, conduits in fluid communication with the discharge ends of the fluid modules, etc.) that extend to, near or above the top of the interlay (e.g., the upper interlay surface) are advantageously adapted to generally align with corresponding passages of the adjacent mattress or upper portion of the bed assembly. According to some embodiments, as illustrated in FIG. 18 for example, a tube or other conduit 194 can be positioned within each fluid outlet or opening 190 along the top surface 188 of the inlay. In some arrangements, such conduits 194 are shaped, sized and otherwise configured to remain firmly in place within each outlet or opening 190 and to extend upwardly, at least slightly, relative to the top surface of the inlay. The mattress or upper portion of the bed assembly can be positioned over the inlay so that the conduits are inserted within corresponding internal passages of the mattress. This can help ensure that the inlay or interlay components are properly aligned with the mattress or upper portion of the bed or other seating assembly. Further, such a configuration can help prevent relative movement of the inlay and the mattress during use, either in lieu of or in addition to using anti-skid surfaces, layers, components or features between such components.

Figure 19A:
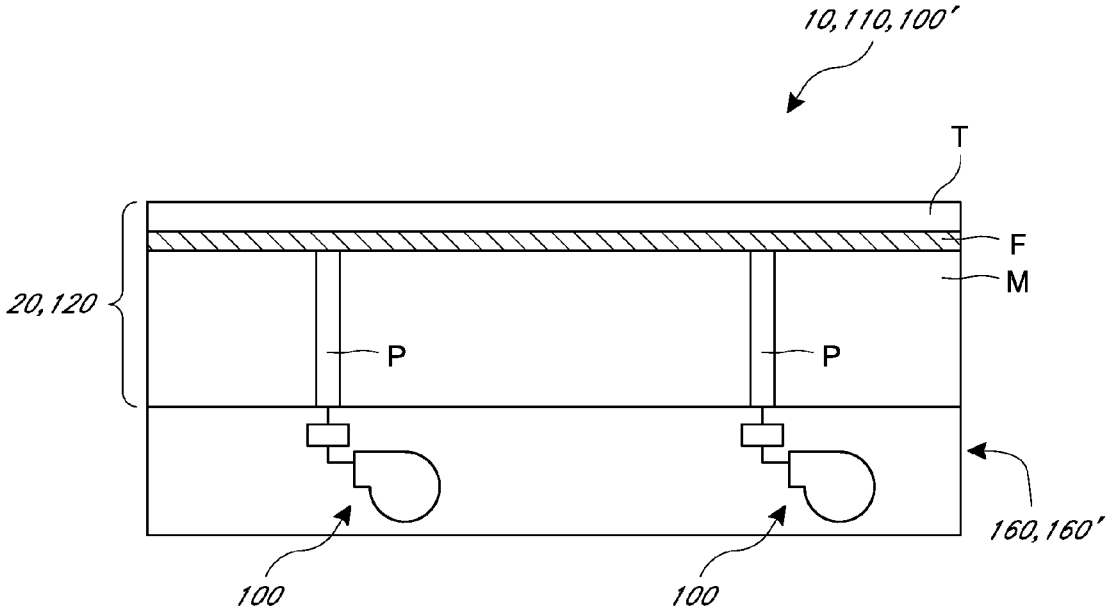
FIGS. 19A and 19B schematically illustrate cross-sectional views of a mattress or upper portion of a climate controlled bed according to certain embodiments.
Figure 19B:
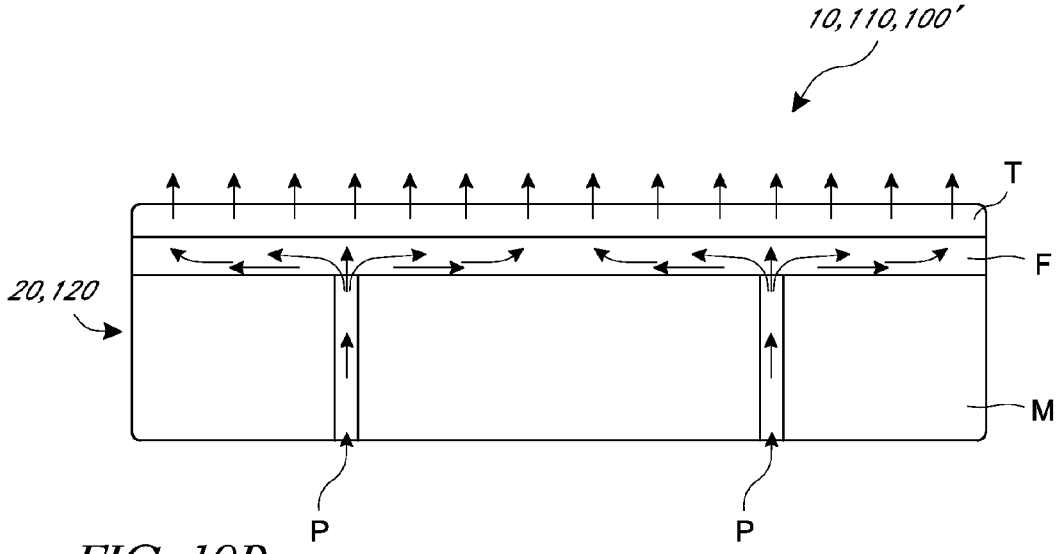
Figure 20:
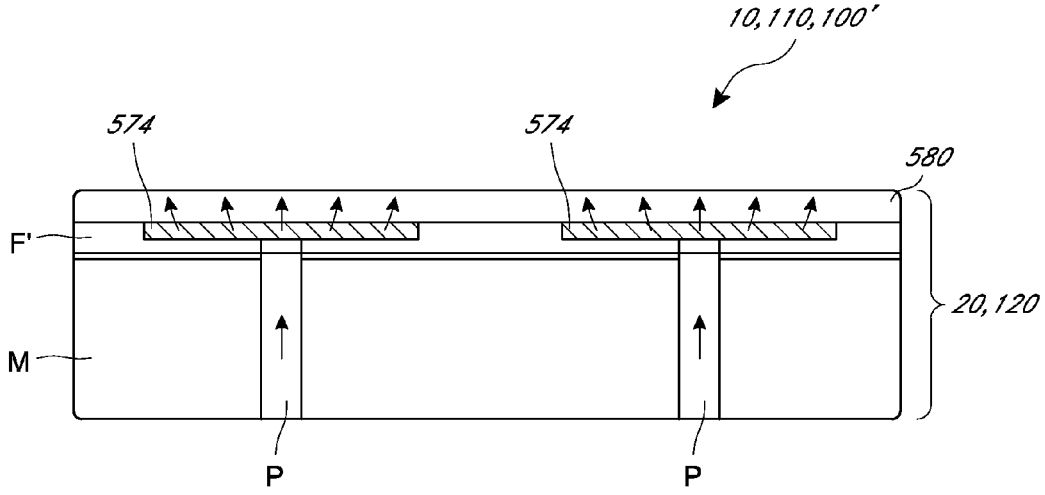
FIG. 20 schematically illustrates a cross-sectional view of a mattress or upper portion of a climate controlled bed according to another embodiment.

As illustrated schematically in FIGS. 19A and 19B, once the interlay or inlay 160, 160' has been aligned relative to the adjacent mattress or upper portion 20, 120, fluid can be delivered from one or more of the fluid modules 100 positioned within the inlay through corresponding internal passages P of the mattress. Air or other fluid is transferred through the passages P to one or more fluid distribution members or layers F (e.g., spacer fabric, open cell foam, other air permeable structures, layers or members, etc.) located along or near the top of the mattress or upper portion 20, 120 of the bed assembly 10, 110, 110'. As shown, one or more air permeable layers T can be located above the fluid distribution members or layers F, as desired or required. Another embodiment of a mattress or upper portion 20, 120 of a bed assembly 10, 110, 110' is schematically illustrated in FIG. 20. As shown, the mattress 20, 120 can include two or more conditioning zones (e.g., using hydraulically distinct portions 574 within the fluid distribution members or layers F). The various embodiments disclosed herein, including the variations of the intermediate layers (e.g., inlays, interlays or components thereof), foundations and/or the like can be incorporated into any type of climate controlled bed or other seating assembly, such as, for example, foam beds (e.g., full foam beds), spring beds, air chamber beds, futons or other material-filled beds, waterbeds, latex beds, air toppers and the like). Additional details regarding various mattresses, upper portions, foundations or lower portions and/or other components of climate controlled beds and other seating assemblies are disclosed in U.S. patent application Ser. No. 11/872,657, filed on Oct. 15, 2007 and issued as U.S. Pat. No. 8,065,763 on Nov. 29, 2011, and U.S. patent application Ser. No. 12/505,355, filed on Jul. 17, 2009 and issued as U.S. Pat. No. 8,181,290 on May 22, 2012, the entireties of both of which are hereby incorporated by reference herein and made a part of the present specification.

In any of the embodiments disclosed herein, the intermediate layer, interlay or inlay can be secured, either temporarily or permanently, to the foundation and/or the mattress or upper portion of the bed or other seating assembly bottom or primary foundation (or lower support member) and a top or secondary foundation (or intermediate support member). The various components of the assembly can be held relative to each other using one or more attachment devices or methods, such as, for example, stitching, zippers, hook-and-loop connections, buttons, straps, bands, other fasteners, adhesives and/or the like.

To assist in the description of the disclosed embodiments, words such as upward, upper, downward, lower, vertical, horizontal, upstream, downstream, top, bottom, soft, rigid, simple, complex and others have and used above to discuss various embodiments and to describe the accompanying figures. It will be appreciated, however, that the illustrated embodiments, or equivalents thereof, can be located and oriented in a variety of desired positions, and thus, should not be limited by the use of such relative terms.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while the number of variations of the inventions have been shown and described in detail, other modifications, which are within the scope of these inventions, will be readily apparent to those of skill in the art based upon this disclosure. It is also contemplated that various combinations or subcombinations of the specific features and aspects of the embodiments may be made and still fall within the scope of the inventions. Accordingly, it should be understood that various features and aspects of the disclosed embodiments can be combined with, or substituted for, one another in order to perform varying modes of the disclosed inventions. Thus, it is intended that the scope of the present inventions herein disclosed should not be limited by the particular disclosed embodiments described above, but should be determined only by a fair reading of the claims.

What is claimed is:

1. A climate controlled bed comprising:

an upper portion comprising at least one fluid distribution member, said fluid distribution member being in fluid communication with the at least one internal passageway of the upper portion, wherein said at least one fluid distribution member is configured to at least partially distribute fluid within said at least one fluid distribution member;

wherein the at least one internal passageway terminates at a bottom surface of the upper portion;

at least one interlay component positioned between the upper potion and a foundation, the foundation being separate from the upper portion and the at least one interlay component, wherein an entirety of the at least one interlay component is positioned above a foundation, at least one fluid module positioned at least partially within the at least one interlay component, wherein the at least one fluid module comprises a fluid transfer device configured to selectively transfer air through at least one outlet located along a top of the at least one interlay component, the at least one fluid module located away from a peripheral edge of the at least one interlay component;

wherein, when the upper portion is properly positioned relative to the at least one interlay component, the at least one outlet is generally aligned and in fluid communication with the at least one internal passageway of the upper portion;

wherein the at least one interlay component comprises at least one fluid channel that extends to an edge of the at least one interlay component, the at least one fluid channel being in fluid communication with an inlet of the at least one fluid module, the at least one fluid channel extending to a bottom surface of the at least one interlay so that the at least one fluid channel is immediately adjacent the foundation when positioned thereon;

wherein, in use, air is delivered from an environment surrounding the bed to the inlet of the at least one fluid module at least in part through the at least one fluid channel of the interlay component; and wherein air discharged by the at least one fluid module is transferred, through the at least one outlet and the at least one internal passageway of the upper portion, to at least one fluid distribution member.

2. The bed of claim 1, wherein the at least one fluid module is embedded within a recess of the at least one interlay component.

3. The bed of claim 1, wherein the at least one fluid module further comprises a thermal conditioning device configured to selectively heat or cool air being transferred by the fluid transfer device.

4. The bed of claim 3, wherein the thermal conditioning device comprises a thermoelectric device.

5. The bed of claim 3, wherein the thermal conditioning device comprises a convective heater.

6. The bed of claim 3, wherein the at least one interlay component additionally comprises at least one waste channel extending from the at least one fluid module to an edge of the at least one interlay component.

7. The bed of claim 1, further comprising at least one conduit extending at least partially through both the at least one opening of the at least one interlay component and the at least one internal passageway of the upper portion.

8. The bed of claim 1, wherein the at least one fluid module comprises at least two fluid modules, wherein the at least one outlet comprises two outlets, wherein each fluid module is in fluid communication with a corresponding outlet.

9. The bed of claim 1, wherein the bed comprises a fixed, non-adjustable bed assembly.

10. The bed of claim 1, wherein the bed comprises an adjustable, reclinable bed, wherein the upper portion and the at least one interlay component are configured to bend along an angle when the bed is adjusted while still permitting air to be delivered from the at least one fluid module to the at least one fluid distribution member of the upper portion.

11. The bed of claim 10, wherein the foundation is configured to selectively bend together with the upper portion and the at least one interlay component.

12. The bed of claim 11, wherein the foundation comprises a plurality of segments that facilitate in allowing the foundation to bend.

13. The bed of claim 1, wherein the at least one interlay component is temporarily or permanently secured to the upper portion.

14. The bed of claim 1, wherein the at least one interlay component is separate and detached from the upper portion.

15. An adjustable climate controlled bed comprising:

an upper portion comprising at least one fluid distribution member, said fluid distribution member being in fluid communication with the at least one internal passageway of the upper portion, wherein said at least one fluid distribution member is configured to at least partially distribute fluid within said at least one fluid distribution member;

wherein the at least one internal passageway terminates at a bottom surface of the upper portion;

a lower portion configured to be positioned below the upper portion and to generally support the upper portion, the lower portion comprising a lower support member and an intermediate support member;

wherein an entirety of the intermediate support member is positioned above the lower support member and is generally secured to the lower support member;

wherein the lower support member comprises at least one opening extending through said lower support member;

wherein the at least one fluid module is configured to be in fluid communication with the at least one opening of the lower support member;

wherein the at least one intermediate support member comprises at least one slotted cavity that at least partially aligns with the at least one opening of the lower support member, a size of the at least one slotted cavity being larger than a size of the at least one opening of the lower support member at a location where the at least one slotted cavity generally aligns with the at least one opening of the lower support member, when viewed from above;

wherein the at least one internal passageway of the upper portion generally aligns with the at least one slotted cavity of the intermediate support member when the upper portion is properly positioned on the lower portion;

wherein the at least one internal passageway is configured to move relative to the at least one slotted cavity while a position of the adjustable bed is modified during use, and wherein the at least one internal passageway remains aligned with and remains in fluid communication with the at least one slotted cavity regardless of the relative movement of the at least one internal passageway and the at least one slotted cavity in order to maintain the at least one internal passageway in fluid communication with the at least one slotted cavity, the at least one opening of the lower support member and the at least one fluid module.

16. The adjustable bed of claim 15, wherein the at least one slotted cavity of the intermediate support member comprises a total of two slotted cavities.

17. The adjustable bed of claim 15, wherein the at least one fluid module is configured to thermally condition air or fluid passing therethrough.

18. The adjustable bed of claim 17, wherein the at least one fluid module comprises at least one thermoelectric device.

19. The adjustable bed of claim 17, wherein the at least one fluid module comprises at least one convective heater.

20. The adjustable bed of claim 15, wherein the at least one fluid module is secured directly to the rear surface of the lower portion.

* * * * *